US006682672B1

(12) United States Patent
Takeuchi

(10) Patent No.: US 6,682,672 B1
(45) Date of Patent: Jan. 27, 2004

(54) PROCESS FOR MAKING POLYMERIC FIBER

(75) Inventor: Kunihiko Takeuchi, Conyers, GA (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 10/184,048

(22) Filed: Jun. 28, 2002

(51) Int. Cl.[7] ..... D01D 4/02; D01D 5/22; D01D 5/253; D01D 5/34; D01D 10/02

(52) U.S. Cl. ..... 264/83; 264/168; 264/172.15; 264/176.1; 264/177.13; 264/211.14

(58) Field of Search ..... 264/83, 168, 172.15, 264/176.1, 177.13, 211.14

(56) References Cited

U.S. PATENT DOCUMENTS

| | | | |
|---|---|---|---|
| 1,618,256 | A | 2/1927 | Wüthrich |
| 3,255,487 | A | 6/1966 | Nieuwenhuysen |
| 3,405,424 | A | 10/1968 | Imobersteg et al. |
| 3,478,389 | A | 11/1969 | Bradley et al. |
| 4,118,456 | A | 10/1978 | Blanding et al. |

(List continued on next page.)

FOREIGN PATENT DOCUMENTS

| | | |
|---|---|---|
| EP | 0552013 | 7/1993 |
| EP | 0630996 | 12/1994 |
| EP | 0486158 | 6/1996 |
| EP | 0719879 | 7/1996 |
| FR | 2582981 | 12/1986 |
| FR | 2790487 | 9/2000 |
| JP | 45-40430 | 12/1970 |
| JP | 58110222 | 6/1983 |
| JP | 61192519 | 8/1986 |
| JP | 62177206 | 8/1987 |
| JP | 3-64511 | 3/1991 |
| JP | 4-289208 | 10/1992 |
| SU | 193680 | 8/1967 |
| SU | 939273 | 6/1982 |
| SU | 1466946 | 3/1989 |
| WO | 97/37065 | 10/1997 |
| WO | 98/15685 | 4/1998 |
| WO | 01/11119 | 2/2001 |

OTHER PUBLICATIONS

English Language Abstract of FR 2 582 981.
English Language Abstract of FR 2 790 487.
English Language Abstract of JP 3–64511.
English Language Abstract of JP 4–289208.
English Language Abstract of JP 58–110222.
English Language Abstract of JP 61–192519.
English Language Abstract of JP 62–177206.
English Language Abstract of SU 193680.
English Language Abstract of SU 939273.
English Language Abstract of SU 1466946.
Slack, "Autocrimp PP Fiber Technology", Chemical Fibers International, vol. 50. pp. 180–181 (2000).
Trent et al., "Ruthenium Tetroxide Staining of Polymers for Electron Microscopy", Macromolecules, vol. 16, No. 4, (1983).

*Primary Examiner*—Leo B. Tentoni
(74) *Attorney, Agent, or Firm*—David Edwards

(57) ABSTRACT

Spinnerette including a plate including a plurality of capillaries which have capillary ends with dividers which divide each capillary end into a plurality of openings, and a process of making polymeric fiber. The process includes passing a molten polymer through a spinnerette comprising a plurality of capillaries which have capillary ends with dividers which divide each capillary end into a plurality of openings so that the molten polymer is formed into separate polymeric fibers for each opening or the molten polymer is formed into partially split fiber for each capillary, and quenching the molten polymer to form polymeric fiber.

24 Claims, 12 Drawing Sheets

U.S. PATENT DOCUMENTS 4,189,293 A 2/1980 Ether
4,191,518 A 3/1980 Kojimoto et al.
4,238,439 A 12/1980 Hyun
4,261,945 A 4/1981 Pfeiffer et al.
4,284,598 A 8/1981 Craig, Jr.
4,316,714 A 2/1982 Pfeiffer et al.
4,383,817 A 5/1983 Mirhej
4,392,808 A 7/1983 Phillips
4,468,365 A 8/1984 Corbett et al.
4,468,366 A 8/1984 Socha, Jr.
4,486,934 A 12/1984 Reed
4,562,029 A 12/1985 Black
4,626,467 A 12/1986 Hostetter
4,731,010 A 3/1988 Cunningham
4,767,309 A 8/1988 Mizuno et al.
4,846,657 A 7/1989 Chao
4,934,916 A 6/1990 Lambertus
4,938,832 A 7/1990 Schmalz
5,057,368 A 10/1991 Largman et al.
5,089,203 A 2/1992 Kragle
5,129,812 A 7/1992 Hodan
5,176,926 A 1/1993 Tung
5,238,385 A 8/1993 Johnson
5,242,644 A 9/1993 Thompson et al.
5,244,614 A 9/1993 Hagen
5,259,753 A 11/1993 Kobsa
5,263,845 A 11/1993 Warren
5,281,378 A 1/1994 Kozulla
5,286,323 A 2/1994 Bagley
5,318,735 A 6/1994 Kozulla
5,330,348 A 7/1994 Aneja et al.
5,403,426 A 4/1995 Johnson et al.
5,407,621 A * 4/1995 Collins et al. ..... 264/168 X
5,431,994 A 7/1995 Kozulla
5,474,720 A 12/1995 Topf
5,487,863 A 1/1996 Cunningham et al.
5,516,273 A 5/1996 Delmore et al.
5,536,461 A 7/1996 King et al.
5,540,953 A 7/1996 Harrington
5,567,493 A 10/1996 Imai et al.
5,629,080 A 5/1997 Gupta et al.
RE35,621 E 10/1997 Schmalz
5,705,119 A 1/1998 Takeuchi et al.
5,721,048 A 2/1998 Schmalz
5,733,646 A 3/1998 Gupta et al.
5,766,523 A 6/1998 Rodgers et al.
5,882,562 A 3/1999 Kozulla
5,888,438 A 3/1999 Guptra et al.
5,948,334 A 9/1999 Takeuchi et al.
5,972,497 A 10/1999 Hirwe et al.
5,985,193 A 11/1999 Harrington et al.
6,116,883 A 9/2000 Takeuchi et al.

* cited by examiner

PROCESS FOR MAKING POLYMERIC FIBER

BACKGROUND OF THE INVENTION

1. Field of the Invention

This invention relates to a spinnerette for splitting a stream of molten polymer into a plurality of fibers as the polymer is extruded through a capillary of the spinnerette. This invention also relates to methods of making polymeric fibers, to polymeric fibers, and to nonwoven articles made from polymeric fibers. More specifically, the fibers of the present invention are capable of providing soft feeling nonwoven materials that have adequate tensile strength. The present invention also relates to fibers that are self-crimping, and which can also be subjected to mechanical crimping.

2. Discussion of Background Information

Nonwoven fabrics, which are used in products such as diapers, involve cloth produced from a preferably random arrangement or matting of natural and/or synthetic fibers held together by adhesives, heat and pressure, or needling. Nonwoven fabrics can be produced in various processes, such as by being spunbonded or cardbonded.

In the production of spunbonded nonwoven fabrics, fibers leaving a spinnerette are collected as continuous fiber, and bounded to form the nonwoven fabric. In particular, in a spunbond process, the polymer is melted and mixed with other additives in an extruder, and the melted polymer is fed by a spin pump and extruded through spinnerettes that have a large number of capillaries. Air ducts located below the spinnerettes continuously attenuate and cool the filaments with conditioned air. Draw down occurs as the filaments are drawn over the working width of the filaments by a high-velocity low-pressure zone to a moving conveyor belt where the filaments are entangled. The entangled filaments are randomly laid down on a conveyor belt which carries the unbonded web for bonding, such as through a thermal calender. The bonded web is then wound into a roll.

In the production of cardbonded nonwoven fabrics, filaments are extruded from spinnerettes in a manner similar to the spunbonded process. The filaments are either wound or collected in a can and subsequently cut into staple form of short length ranging from 0.5 mm to 65 mm which are carded and then bonded together, e.g., by a calender having heating points, or by hot air, or by heating through the use of ultrasonic welding. For example, staple fibers can be converted into nonwoven fabrics using, for example, a carding machine, and the carded fabric can be thermally bonded.

Staple fiber production processes include the more common two-step "long spin" process and the newer one-step "short spin" process. The long spin process involves a first step comprising the melt-extrusion of fibers at typical spinning speeds of 300 to 3000 meters per minute. In the case of polypropylene the spinning speeds usually range from 300 to 2,500 meters per minute (and up to 10,000 meters per minute for polyester and Nylon). The second step involved draw processing which is usually run at 50 to 300 meters per minute. In this process the fibers are drawn, crimped, and cut into staple fiber.

The one-step short spin process involves conversion from polymer to staple fibers in a single step where typical spinning speeds are in the range of 50 to 250 meters per minute or higher. The productivity of the one-step process is maintained despite its low process speed by the use of about 5 to 20 times the number of capillaries in the spinnerette compared to that typically used in the long spin process. For example, spinnerettes for a typical commercial "long spin" process include approximately 50–4,000, preferably approximately 2,000–3,500 capillaries, and spinnerettes for a typical commercial "short spin" process include approximately 500 to 100,000 capillaries preferably about 25,000 to 70,000 capillaries. Typical temperatures for extrusion of the spin melt in these processes are about 250–325° C. Moreover, for processes wherein bicomponent fibers are being produced, the numbers of capillaries refers to the number of filaments being extruded.

The short spin process for manufacture of polypropylene fiber is significantly different from the long spin process in terms of the quenching conditions needed for spin continuity. In the short spin process, with high capillary density spinnerettes spinning around 100 meters/minute, quench air velocity is required in the range of about 900 to 3,000 meters/minute to complete fiber quenching within one inch below the spinnerette face. To the contrary, in the long spin process, with spinning speeds of about 1,000–2,000 meters/minute or higher, a lower quench air velocity in the range of about 15 to 150 meters/minute, preferably about 65 to 150 meters/minute, can be used.

With the above production processes in mind, the most desirable fiber for nonwoven applications has properties which will give high fabric strength, soft touch, and uniform fabric formation. The fiber is often used to form nonwoven cover stock, which is typically used for hygiene products, such as a top sheet of a diaper. In such applications, one face or side of the cover stock material is placed in contact with a human body, for example, placed on the skin of a baby. Therefore, it is desirable that the face in contact with the human body exhibit softness.

Softness of the nonwoven material is particularly important to the ultimate consumer. Thus, products containing softer nonwovens would be more appealing, and thereby produce greater sales of the products, such as diapers including softer layers.

Recent advancement in spunbonded fabric technology has improved the uniformity and fabric strength of the spunbonded fabrics. In the nonwoven market, spunbonded fabrics are taking over a good portion of the cardbonded fabric market. Accordingly, there exists a need for improved cardbonded fabrics in the nonwoven materials market.

Still further, WO 01/11119 and Slack, Chemical Fibers International, Vol. 50, April 2000, pages 180–181, the disclosures of which are incorporated by reference herein in their entireties, disclose fibers having a fat C-shaped cross-section.

Although currently available technology is usually able to achieve the desired level of fabric bulkiness, strength and softness, currently available technology may not always be economical. Some ingredients may be prohibitively costly, and the production rate may be too low to be economical. Also, it is known that fabric strength and softness can be increased if a finer fiber is used in constructing the nonwoven fabric. Many hygiene products currently in production have spin denier ranging from 2.0 to 4.0 dpf. The production of finer fiber, however, usually involves reduced production rates. Accordingly, there exists a need for improved fibers for either spunbonded or cardbonded fabrics which are economical to manufacture.

SUMMARY OF THE INVENTION

The present invention relates to the production of fibers, preferably fine denier fibers.

The present invention relates to the production of fibers, preferably fine denier fibers, at high production rates.

The present invention relates to stressing extruding polymer at an exit of a capillary to divide a fiber into a plurality of fibers.

The present invention relates to stressing extruding polymer at an exit of a capillary to affect the cross-sectional shape of the fiber.

The present invention also relates to providing a spinnerette for splitting a stream of molten polymer into a plurality of fibers as the polymer extruded through the spinnerette.

The present invention also relates to providing a differential stress to the extruding polymer at an exit of capillaries in the spinnerette to affect the cross-sectional shape of the fiber.

The present invention also relates to providing self-crimping fibers which may be used with or without mechanical crimping.

The present invention also relates to providing fibers with and without a skin-core structure. For example, the hot extrudate can be extruded at a high enough polymer temperature in an oxidative atmosphere under conditions to form a skin-core structure.

The present invention also relates to providing fibers for making nonwoven fabrics, such as cardbonded or spunbonded nonwoven fabrics.

The present invention also relates to providing thermal bonding fibers for making fabrics, especially with high softness, cross-directional strength, elongation, and toughness.

The present invention also relates to providing lower basis weight nonwoven materials that have strength properties, such as cross-directional strength, elongation and toughness that can be equal to or greater than these strength properties obtained with fibers at higher basis weights made under the same conditions.

The present invention also relates to providing fibers and nonwovens that can be handled on high speed machines, including high speed carding and bonding machines, that run at speeds as great as about 500 m/min.

The present invention relates to a spinnerette comprising a plate comprising a plurality of capillaries which have capillary ends with dividers which divide each capillary end into a plurality of openings.

The present invention also relates to a process of making polymeric fiber comprising passing a molten polymer through a spinnerette comprising a plurality of capillaries which have capillary ends with dividers which divide each capillary end into a plurality of openings so that the molten polymer is formed into separate polymeric fibers for each opening or the molten polymer is formed into partially split fiber for each capillary, and quenching the molten polymer to form polymeric fiber.

The plurality of capillaries can have a diameter of about 0.2 to about 1.3 mm.

The plurality of capillaries can comprise a capillary upper diameter which is less than a capillary lower diameter, and wherein a junction between the capillary upper diameter and the capillary lower diameter forms a ridge. The capillary lower diameter can be about 0.2 to about 1.3 mm. The capillary upper diameter can be about 0.6 to about 3.0 mm.

The ridge can comprise a ridge width of about 0.04 to about 0.8 mm.

The dividers can comprise a divider width which is about 0.1 to about 0.4 mm.

The spinnerette can further comprise a face having the plurality of openings, and wherein the dividers have divider ends which are flush with the face.

The dividers can comprise a divider height which is about 0.2 to about 2.0 mm.

The plurality of capillaries can comprise a ratio of a capillary upper diameter to a capillary lower diameter which is about 4:1 to about 1.5:1.

The plurality of openings comprise two, three, four or more openings.

The divider can have a tapered width.

The polymer preferably comprises polypropylene.

The polymer flow rate per capillary can be about 0.02 to about 0.9 gm/min/capillary.

The polymeric fiber can have a spun denier of about 0.5 to about 3.

The plurality of capillaries can have a diameter of about 0.2 to about 1.3 mm.

The spinnerette can be heated, such as electrically heated.

The polymeric fiber can have a substantially half-circular cross-section or a fat C-shaped cross section.

The polymeric fiber can be self-crimping, and the process can further comprise mechanically crimping of the polymeric fiber.

The polymeric fiber can comprise a skin-core polymeric fiber. Moreover, the polymer can be extruded in an oxidative atmosphere under conditions such that the polymeric fiber has a skin-core structure.

The present invention also relates to nonwoven materials comprising polymeric fiber made by the process of the present invention, to hygienic products comprising at least one absorbent layer, and at least one nonwoven fabric comprising fiber made by the process of the present invention thermally bonded together, and to polymeric fiber produced by the process of the present invention. The present invention also relates to wipes, which can be hydroentangled fibers of the present invention.

BRIEF DESCRIPTION OF THE DRAWINGS

The present invention is further described in the detailed description which follows, in reference to the noted plurality of non-limiting drawings, and wherein.

DETAILED DESCRIPTION OF THE INVENTION

Figure 1A:
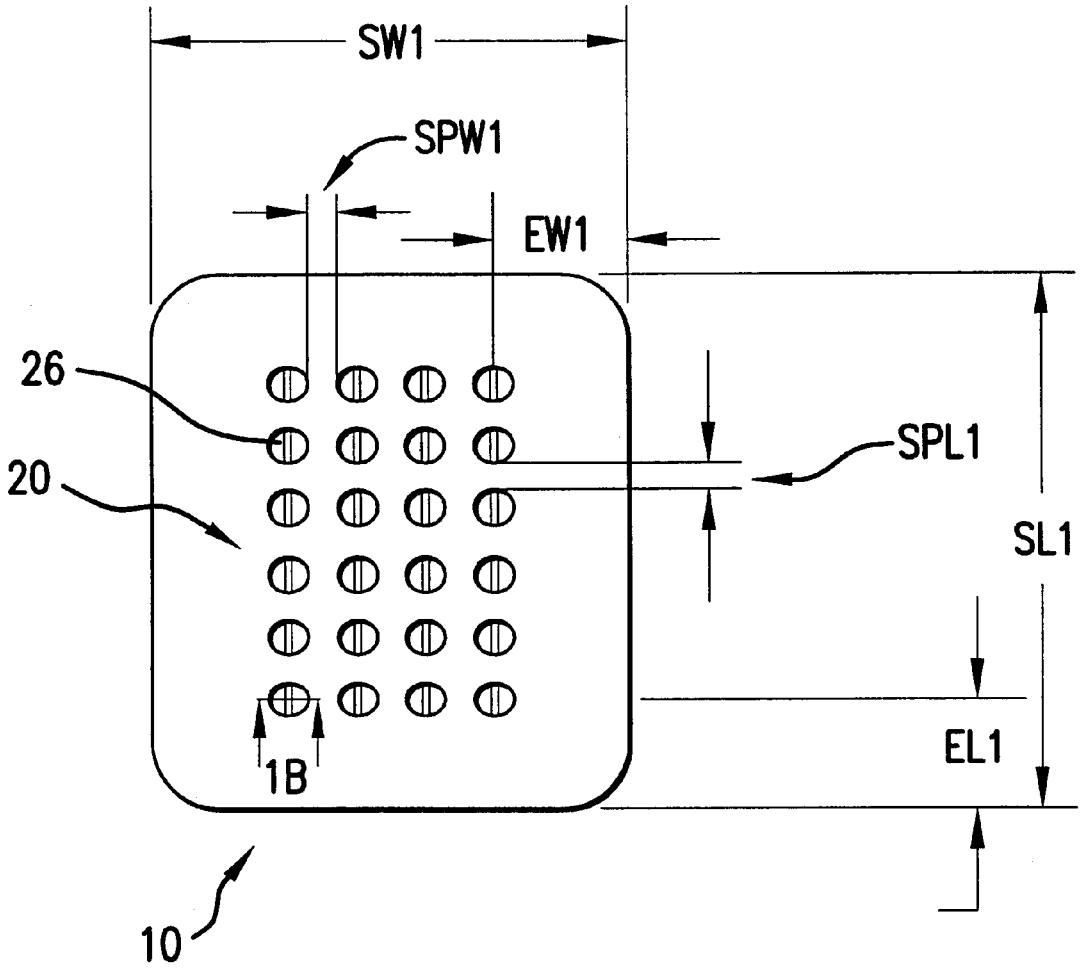
FIG. 1A is a bottom view of a first embodiment of a short spin spinnerette according to the present invention involving 2-way split capillaries.

The particulars shown herein are by way of example and for purposes of illustrative discussion of the various embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description taken with the drawings making apparent to those skilled in the art how the several forms of the invention may be embodied in practice.

All percent measurements in this application, unless otherwise stated, are measured by weight based upon 100% of a given sample weight. Thus, for example, 30% represents 30 weight parts out of every 100 weight parts of the sample.

Unless otherwise stated, a reference to a compound or component, includes the compound or component by itself, as well as in combination with other compounds or components, such as mixtures of compounds.

Before further discussion, a definition of the following terms will aid in the understanding of the present invention.

FILAMENT: a continuous single fiber extruded from a single capillary.

STAPLE FIBER: cut fibers or filaments.

FIBER: filament or staple fiber.

DPF: weight in grams of 9,000 m (9 km) of filament.

DOFFER: a device that transfers material from one part to another part of a textile machine or carding machine.

COHESION: the ability of the fibers to hold together, determined by measuring the force required to slide fibers in a direction parallel to their length.

CPI ("crimps per inch"): the number of "kinks" per inch of a given sample of bulked fiber measured under zero tensile stress.

TENACITY: the breaking force divided by the denier of the fiber.

ELONGATION: the % length elongation at break.

MELT FLOW RATE: determined according to ASTM D-1238-86 (condition L; 230/2.16).

Before referring to the drawings, an overview of the present invention is in order. The present invention relates to spinnerettes including a plurality of capillaries, with the capillaries, preferably each capillary, including a mechanism for stressing the polymer so that when the polymer is extruded from the spinnerette at least a portion of the polymer is divided. In this manner, when the fiber exits the capillaries, the polymer is at least partially split such that the resulting fiber has a cross-section that is missing a section thereof, such as eclipse shape, or is split, such as by being completely split to form a plurality of separate fibers.

Expanding upon the above, the mechanism for stressing the polymer melt can stress the polymer melt sufficiently so that the resulting fiber comprises a plurality of separate fibers. In this manner, the fibers exit the spinnerette almost as a single fiber. However, the fiber does not comprise a single fiber, but comprises a plurality of fibers, such as two or more fibers, that are physically next to each other. Separation of these physically proximate fibers can be obtained by appropriate temperature and quench conditions. For example, fiber with the proper melt flow can have a sufficiently high intensity quench to cause the fibers to separate. However, the quench intensity is preferably low enough to avoid unacceptable filament breaking during spinning.

The present invention further involves methods for making fibers using spinnerettes according to the present invention. The present invention also involves fibers which may be made by use of such spinnerettes, nonwoven materials made from the fibers, and articles incorporating the nonwoven materials.

Figure 8:
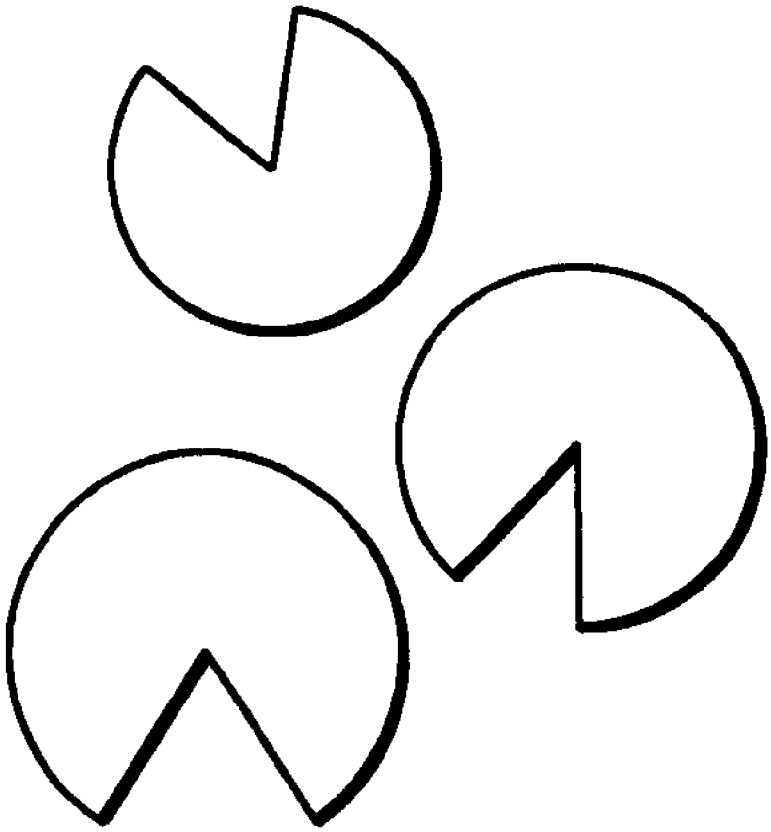
FIG. 8 is an exemplary illustration of fiber having a fat C-shaped cross-section taken from a microscopic photograph at 400 magnification of an 11.2 denier fiber.

The spinnerette of the present invention can include multiple capillaries which each can have an end which is separated by a divider into a plurality of openings. For instance, the ends of the capillaries may be separated into two, three, four, or more openings, such that the polymer would be split into two, three, four, or more fibers, or caused to have a partially split filament resulting in a modified cross-section, e.g. notched fiber, such as an eclipsed cross-section, such as a fat C-shaped cross-section as shown in FIG. 8, WO 01/11119 and Slack, Chemical Fibers International, Vol. 50, April 2000, pages 180–181, which are incorporated by reference herein in their entireties.

When the molten polymer passes through a given capillary and strikes the at least one divider, the polymer melt encounters added shear and caused to divide into separate flows or substantially separate flows which form the separate fibers or partially split fibers. The spinnerette of the present invention may allow production of fine polymeric fibers at relatively low loss in production rates. Thus, the spinnerette of the present invention can economically produce fine polymeric fibers. For example, fiber as small as 1.2 dpf or less, such as 1 denier or less, or 0.75 denier or less, or 0.65 spun denier or less may be economically produced.

Another advantage of the present invention is that the resulting fiber may be self-crimping. For instance, in accordance with the invention, the crimp pattern of self-crimped polymeric fibers, such as having a half-circular cross-section, may be very sinusoidal and uniform, a preferred feature for uniform fabric. The self-crimped fiber may also be mechanically crimped without a prior drawing to preserve desirable fiber properties and of the tow. It is preferable to mechanically crimp without a prior drawing to have reduced processing costs.

Looking at the present invention in more detail, the at least one divider of the present invention may divide the end of a corresponding capillary into a plurality of openings which form separate channels. Thus, the at least one divider may comprise a bridge which is connected at two or more locations to the side of the capillary.

The polymer flow should be sufficiently stressed, such as being significantly restricted or even prevented, at the one or more locations where the two or more of the plurality of openings are connected to each other, so that the divider divides the polymer into separate flows or substantially separate flows which form the separate fibers or partially split fibers.

As the polymer exits the spinnerette, the separately formed filaments may be physically proximate, e.g., being in contact with each other. Without wishing to be bound by theory, one of the contributing factors for contacting of the filaments may be die swell. Thus, as noted above, the fiber does not comprise a single fiber, but comprises a plurality of fibers, such as two or more fibers, that are physically next to each other. Separation of these physically proximate fibers can be obtained by selecting proper fiber melt flow rates and quench conditions. The average melt flow rate of the fiber is preferably of a sufficiently low value that the fibers are less sticky, such as preferably less than about 30, more preferably less than about 20. Moreover, shrinkage, flow instability, and stress induced surface tension effect may contribute to fiber separation.

In addition to the at least one divider, the capillaries may include mechanisms for increasing the shear stress of the polymer. For instance, the capillaries of the present invention may include a lower section and an upper section wherein the lower section has a diameter which is less than a diameter of the upper section. The junction between the upper section and lower section forms a ridge which facilitates the splitting process by increasing the shear stress of the polymer exiting the spinnerette. More specifically, the narrower conduits created by ridges increase pressure drop which is balanced by increased shear stress.

The fibers made by the spinnerette of the present invention may be in various forms such as filaments and staple fibers. Staple fiber is used in a multitude of products, such as personal hygiene, filtration media, medical, industrial and automotive products and commonly ranges in length from about 0.5 to about 16 cm. Preferably, for instance, staple fibers for nonwoven fabrics useful in diapers have lengths of about 2.5 cm to 7.6 cm, more preferably about 3.2 cm to 5 cm.

The fibers of the present invention may have distinctive cross-sections. For instance, if a round capillary is divided into two half-circular openings by a center divider, the resulting polymeric fibers may have a substantially half-circular cross-section. Thus, half-circular cross-section polymeric fibers may be obtained by splitting one stream of polymer into two fibers. Alternatively, if a round capillary is trisected into three piece-of-pie-shaped (i.e., triangular with one curved side) openings, the resulting polymeric fibers may have a substantially piece-of-pie-shaped cross-section. Similar cross-sections may result if a round capillary is divided into four or more openings. It may also be possible to have a capillary end which is divided into several (e.g., three or four) circular openings (preferably arranged symmetrically in the capillary opening) in which case the resulting polymeric fibers may have a substantially circular, small diameter cross-section.

Still further, if the divider can be shaped to provide different stresses along its length to obtain partial splitting of the resulting fibers, whereby the resulting filaments will have a cross-section that has a portion of the cross-section missing. In such an instance, the fiber can have a fat C-shape, such as shown in FIG. 8. Such a fiber cross-sectional shape is particularly preferred due to its resiliency when pressure is applied to the side of the fiber, and fiber of this shape tends to face non-symmetrical quench resulting in self-crimping fiber.

The resulting fibers may also have a skin-core structure. In this regard, the spinnerette of the present invention is particularly suited for the short spin processes, such as disclosed in U.S. Pat. Nos. 5,985,193, 5,705,119 and 6,116,883, the disclosures of which are incorporated by reference herein in their entireties. The spinnerette of the present invention, however, may also be used in long spin processes, such as those disclosed in U.S. Pat. Nos. 5,281,378, 5,318,735 and 5,431,994, and a compact long spin process, such as disclosed in U.S. Pat. No. 5,948,334, the disclosures of which are incorporated by reference herein in their entireties.

The present invention also involves methods of manufacturing nonwoven fabrics as well as the products thereof. The fabric produced from the fiber of the present invention is preferably very bulky, soft and uniform. This fiber is not only a superior fiber for cardbonded processes, e.g., for a coverstock application, but it also can be a good candidate for spunbonded processes since due to the self-crimping nature of the fiber one can obtain a cohesive and uniform fabric.

Referring to the drawings, FIG. 1A shows a short spin spinnerette 10 for making polymeric fibers in accordance with the present invention. The width and length of the spinnerette depend upon the throughput requirements of the spinnerette. It should thus be noted that the various dimensions of the spinnerette and parts thereof, respectively given in the following refer to a typical spinnerette used in commercial production and may be different for spinnerettes used for other (commercial and non-commercial, e.g., experimental) purposes.

Spinnerette 10 can have a width (SW1) of about 200 to 700 mm for long spin and about 500 to 700 mm for short spin or more than 2,000 mm for spun bond. The spinnerette 10 can have a length (SL1) of about 50 to 200 mm for long spin and about 30 to 100 mm for short spin. For short spin, round spinnerettes are also commonly used. In that case, the diameter of the spinnerette can range from 200 to 500 mm, preferably from 300 to 500 mm. Preferably, the capillaries will be in the portion of the spinnerette comprising the outer 30 to 50 mm of the diameter.

Figure 1B:
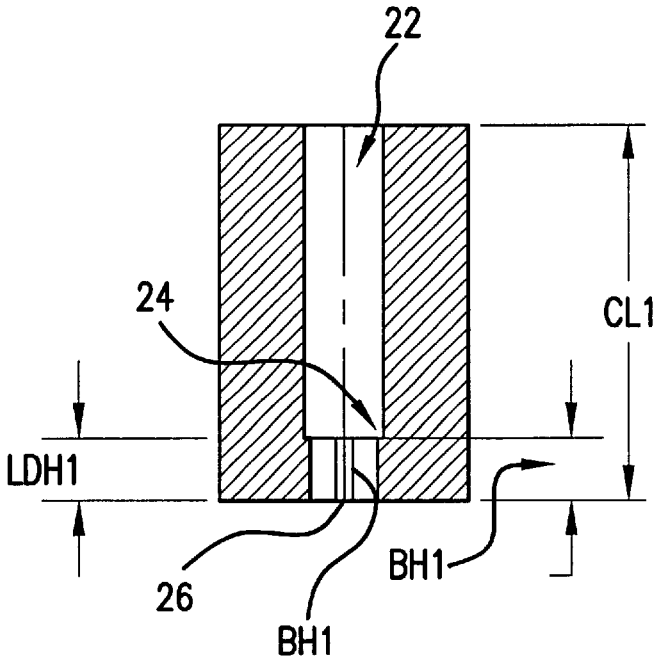
FIG. 1B is a cross-section taken along line 1B of FIG. 1A of a capillary of the first embodiment of the spinnerette of the present invention involving the 2-way split capillaries.
Figure 1C:
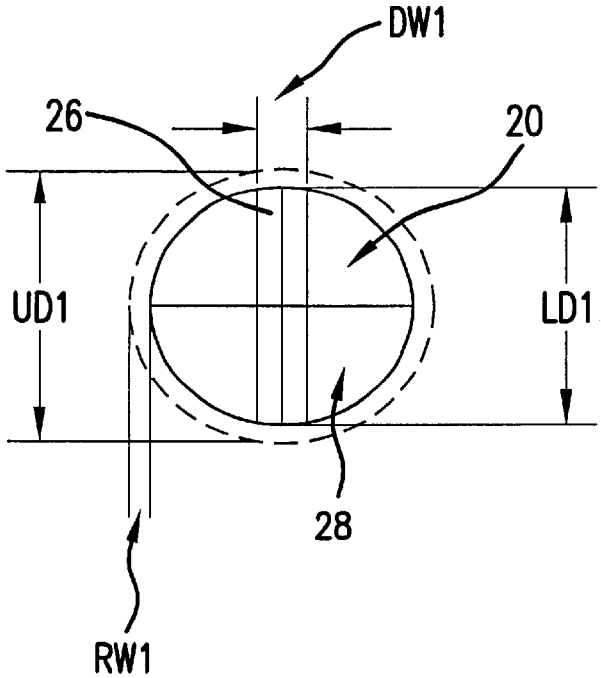
FIG. 1C is a bottom view of a capillary of the first embodiment of the spinnerette of the present invention involving 2-way split capillaries.

The spinnerette 10 has capillaries 22 including capillary ends 20 (FIGS. 1B and 1C). The number of the capillaries 22 primarily depends on SW1 and SL1. The higher SW1 and/or SL1 the more capillaries 22 can be present.

Although capillary ends 20 may be arranged in essentially any pattern so long as there is enough space between the capillary ends 20 to allow proper quenching, the capillary ends 20 of this first embodiment are arranged in rows and columns (FIG. 1A). The length of each space between the rows of the capillary ends 20 (SPL1) is, for short spin, preferably about 0.2 to 3 mm, more preferably about 0.4 to 2 mm, and most preferably about 0.5 to 1.5 mm. The distance (EL1) between centers of capillary ends of the rows nearest to the edges of the spinnerette is preferably about 0.5 to 2.0 mm, more preferably about 0.7 to 1.8 mm, and most preferably about 1.0 to 1.5 mm.

The length of each space between the columns of the apertures (SPW1) is preferably about 0.2 to 3 mm, more preferably about 0.4 to 2 mm, and most preferably about 0.5 to 1.5 mm. The distance between centers of the capillary ends of the columns nearest to the edges of the spinnerette (EW1) is preferably about 0.5 to 2.0 mm, more preferably about 0.7 to 1.8 mm, and most preferably about 1.0 to 1.5 mm.

It is noted that FIGS. 1–4 are directed to short spin spinnerettes and FIG. 5 is directed to a long spin spinnerette. One having ordinary skill in the art following the guidance set forth herein would be capable of directing the disclosure herein to either of short spin and long spin spinnerettes as well as spinnerettes for spunbond, such as using dimensions associated for long spin for spunbond spinnerettes. Thus, for example, the length of each space between the columns of the apertures (SPW1) and the length of each space between the columns of the apertures (SPW1), for long spin, is preferably about 0.2 to 10 mm, more preferably about 0.4 to 8 mm, more preferably about 0.8 to 6 mm, and most preferably about 1 to 5 mm.

Referring to FIG. 1B, the capillaries 22 have a length (CL1) of preferably about 2.0 to 7 mm for short spin setup and about 20 to 60 mm for long spin setup, more preferably about 2.5 to 6 mm for short spin setup and 35 to 55 mm for long spin setup, and most preferably about 3 to 5.5 mm for short spin setup and 30 to 40 mm for long spin setup.

Referring to FIG. 1C, the capillaries 22 have a lower diameter (LD1) of preferably about 0.2 to 1.5 mm, more preferably about 0.3 to 1 mm, and most preferably about 0.4 to 0.8 mm. The lower diameter (LD1) has a height (LDH1) of preferably about 0.2 to 2.0 mm, more preferably about 0.6 to 1.6 mm, more preferably about 0.4 to 1.4 mm, and most preferably about 0.4 to 1.2 mm. The capillaries can have an upper diameter (UD1) of preferably about 0.6 to 2.0 mm, more preferably about 0.7 to 1.5 mm, and most preferably about 0.8 to 1.0 mm.

The junction between the lower diameter (LD1) and the upper diameter (UD1) forms a ridge 24. The width of the ridge 24 (RW1) is preferably about 0.04 to 0.15 mm, more preferably about 0.06 to 0.12 mm, and most preferably about 0.08 to 0.10 mm.

Although the capillaries 22 of this first embodiment have a circular cross-section, the cross-section of the capillaries 22 is not limited. For instance, the cross-section of the capillaries 22 may be diamond-shaped, delta-shaped, ellipsoidal (oval), polygonal or multilobal, e.g., trilobal or tetralobal.

The capillaries 22 have dividers 26 which height extends into the capillaries 22 with the divider ends being preferably flush with the spinnerette face. In the embodiment of FIG. 1, each of the capillary ends 20 is divided in half by placing the divider 26 at the center of each capillary end 20. Alternatively, the dividers may be placed off-center in the spinnerette apertures. Taking into consideration that the short spin process quenches fibers quicker than the long spin process, the width of the divider 26 (DW1) is preferably at least about 0.15 mm for long spin setup and at least about 0.1 mm for short spin setup, more preferably about 0.15 to 0.4 mm for long spin setup and about 0.1 to 0.4 mm for short spin setup, and most preferably about 0.1 to 0.2 mm for short spin setup and about 0.2 to 0.3 mm for long spin setup.

The height of the divider 26 (DH1) is preferably greater than the height LDH1, and is preferably about 0.2 to 3.5 mm, more preferably about 0.4 to 2.5 mm, and most preferably about 0.5 to 2 mm, with one preferred value being about 1.2 mm.

To facilitate splitting of the molten polymer, the following ratios are preferred. The ratio of the height of the divider (DH1) to the width of the divider (DW1) is preferably about 1:1 to 6:1, more preferably about 1.5:1 to 5:1, and most preferably about 3:1 to 4:1. The ratio of the width of the divider (DW1) to the width of the ridge (RW1) is preferably about 5:1 to 3:1, more preferably about 4.1:1 to 3.2:1, and most preferably about 3.75:1 to 3.3:1. The ratio of the upper diameter (UD1) to the lower diameter (LD1) is preferably about 4:1 to 1.5:1, more preferably about 2.3:1 to 1.7:1, and most preferably about 2:1 to 1.8:1. The ratio of the lower diameter (LD1) to the width of the divider (DW1) is preferably about 4:1 to 2:1, more preferably about 3.5:1 to 2.25:1, and most preferably about 3:1 to 2.5:1. The open area of a capillary end, which in FIGS. 1A–1C includes the open areas of each of the two semicircular apertures 28, is preferably about 0.03 to 0.6 $mm^2$, more preferably about 0.04 to 0.4 $mm^2$, and most preferably about 0.05 to 0.2 $mm^2$.

In general, the flow rate of polymer per capillary for long spin is preferably about 0.02 to 0.9 g/min/capillary, more preferably about 0.1 to 0.7 g/min/capillary, and most preferably about 0.2 to 0.6 g/min/capillary. Moreover, in general, the flow rate of polymer per capillary for short spin is preferably about 0.01 to 0.05 g/min/capillary, more preferably about 0.015 to 0.04 g/min/capillary, and most preferably about 0.02 to 0.035 g/min/capillary.

As discussed above, a purpose of the divider 26 is to increase shear stress and create a pseudo-unstable flow near the capillary exit for ease of splitting the molten polymer into multiple fibers. As the polymer exits the spinnerette, the filaments can merge into contact with each other so as to be physically next to each other such as due to die swell. Soon thereafter, however, and without wishing to be bound by theory, the rapid cooling due to applied quench air causes the fiber to split into multiple filaments due to shrinkage, flow instability, and stress induced surface tension effect.

To provide physical separation of the fibers from each other, quenching is desirably accomplished in a short period of time. If the quenching is too rapid, however, the filament can be broken. The quench air speed of the present invention is preferably 50 to 600 ft/min. for long spin setup and 1,000 to 10,000 ft/min. for short spin setup, more preferably 100 to 500 ft/min. for long spin setup and 3,000 to 8,000 ft/min. for short spin setup, and most preferably 200 to 450 ft/min. for long spin setup and 4,000 to 6,000 ft/min. for short spin setup. In view of the above, the short spin setup will separate fibers easier than the long spin setup because the filament quench is accomplished within a short distance compared to the long spin setup. Because of the difference in quench speed between the long spin setup and the short spin setup, the long spin setup generally requires wider dividers (greater DW) as noted above.

Other variables that affect the quench and separation of fibers, is the spinnerette design including the number of capillaries and rows of capillaries, the position of the quench nozzles with respect to the fibers, fiber melt flow rate and temperature of the extrudate. For example, the spinnerette for a short spin system usually has less rows of capillaries than a spinnerette for a long spin system. For example, for a short spin system wherein the spinnerette has about 14 rows, the spinnerette in a long spin system would have about 30 rows. Moreover, in a short spin system, the fiber can be cooled from an exemplary temperature of about 270° C. to about 30° C. with the nozzle being positioned about 2 to 5 cm from the outermost fibers, and solidified in a distance of about 1.5 cm. In contrast, in a long spin system, the fiber can be cooled from an exemplary temperature of about 270° C. to about 30° C. with the nozzle being positioned about 10 to 13 to cm from the outermost fibers, and solidified in a distance of about 5 to 7.5 cm. Thus, one having ordinary skill in the art following the guidance herein would understand that the intensity of the quench should be adjusted depending upon variables including spinnerette design, quench conditions, and system setup including long and short spin setup to achieve separation of the physically contacting fibers.

The fiber of the present invention usually self-crimps as it is extruded from the spinnerette. One reason that the fiber self-crimps is the very small gap between the adjacent filaments created by the split. This small gap results in an asymmetrical fiber quenching which results in self-crimping. Another reason why the fiber may self-crimp is that non-symmetrical cross-section fibers undergo uneven cooling history. Further, if the spinnerette is heated, irregular heating may cause crimping. The irregular heating places asymmetrical stress on the material which causes crimping. For example, if the spinnerette is heated by resistance heating, such as disclosed in U.S. Pat. Nos. 5,705,119 and 6,116,883 to Takeuchi et al. the disclosures of which are incorporated by reference herein in their entireties, irregular heating caused by different current paths around the fiber may cause crimping. If the spinnerette is not heated, self-crimping will usually occur but the degree of self-crimping is often different than if the spinnerette were heated. It is noted that rows of capillaries in the spinnerette are normal to the quench, and columns of capillaries are in the direction of the quench, and quench direction usually has an effect on the cooling characteristics, such as self-crimping, especially with a C-shaped fiber.

The resulting fibers may have crimp measurements which are favorable to those crimps created by mechanical crimpers. For example, the resulting fibers may have a longer crimp leg length, a smaller crimp angle (angle between the folds along the fibers), and a lower ratio of relaxed to stretched length. The crimp leg length (distance between the folds) is preferably about 0.02 to 0.04 inch, more preferably about 0.02 to 0.03 inch. The crimp angle is preferably about 80° to 170°, more preferably about 95° to 165°. The ratio of relaxed to stretched length is preferably about 0.8:1 to 0.98:1, more preferably about 0.85:1 to 0.96:1, and most preferably about 0.90:1 to 0.95:1. Any mechanical crimping can be used to provide any desired crimp, such as by adjustment of flapper pressure.

Figure 2A:
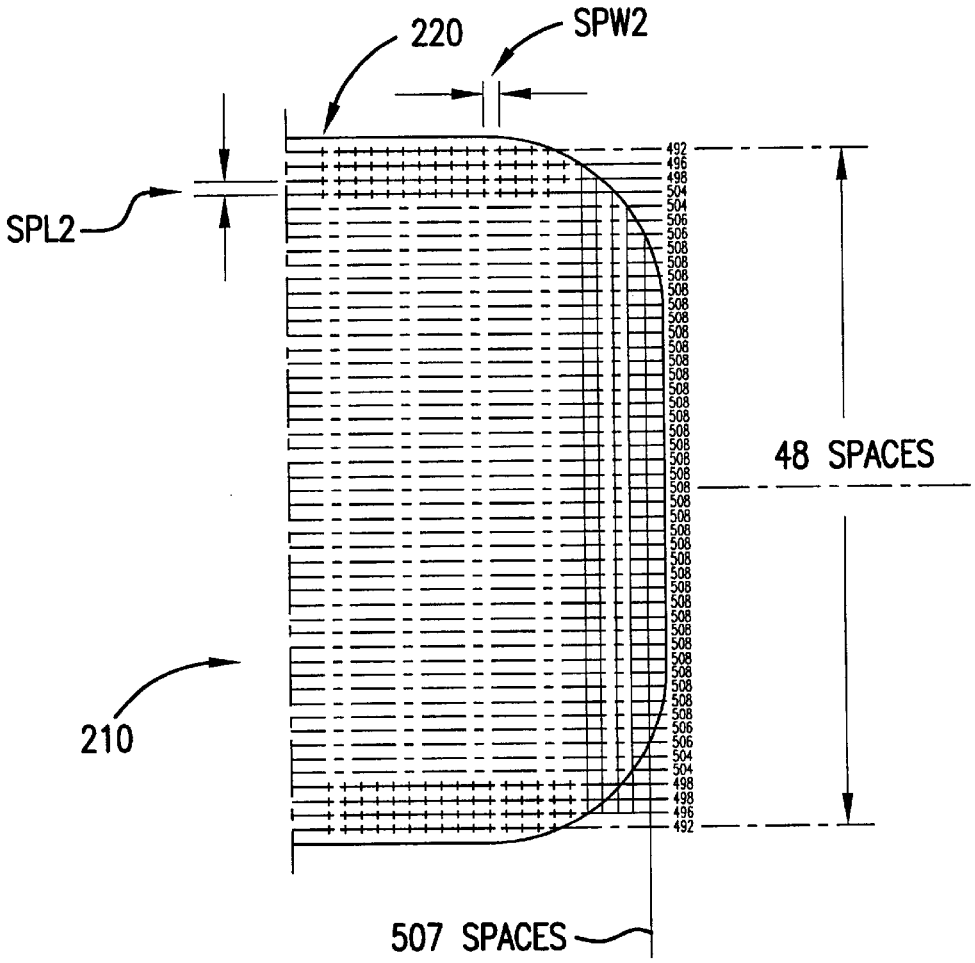
FIG. 2A is a bottom view of a second embodiment of a short spin spinnerette of the present invention involving a 2-way split capillary in which the spinnerette has more capillaries than the first embodiment.
Figure 2C:
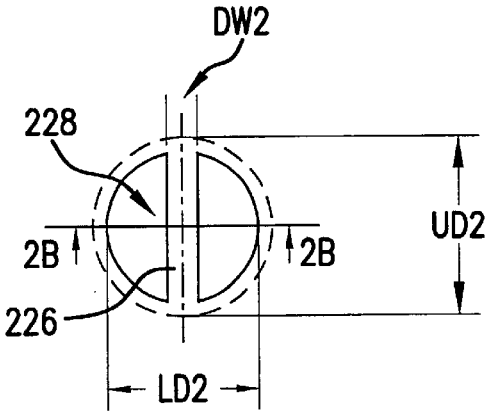
FIG. 2C is a bottom view of a capillary of the second embodiment of the spinnerette of the present invention involving a 2-way split capillary in which the spinnerette has more capillaries than the first embodiment.
Figure 2B:
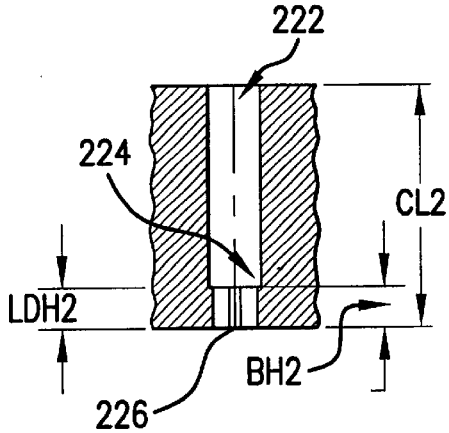
FIG. 2B is a cross-section taken along line 2B of FIG. 2C of a capillary of the second embodiment of the spinnerette of the present invention involving a 2-way split capillary in which the spinnerette has more capillaries than the first embodiment.

FIGS. 2A, 2B, and 2C illustrate a second embodiment of the spinnerette of the present invention which is similar to the embodiment of FIGS. 1A–1C and which is intended for large scale production. In this second embodiment, the spinnerette 210 includes forty-nine (49) rows and five hundred eight (508) columns of capillaries 222. The length of each space between each row (SPL2) is preferably about 0.5 to 1.5 mm, more preferably about 0.8 to 1.3 mm, and most preferably about 1.0 to 1.2 mm. The length of each space between the columns (SPW2) is about 0.6 to 1.5 mm, more preferably about 0.8 to 1.2 mm, and most preferably about 0.9 to 1.0 mm.

Referring to FIG. 2B, the capillaries 222 can have a length (CL2) which can be the same as the length (CL1) of the first embodiment, and can be determined with spinnerette thickness.

Referring to FIG. 2C, the capillaries 222 have a lower diameter (LD2), a lower diameter height (LDH2) and an upper diameter (UD2) which are the same as the lower diameter (LD1), the lower diameter height (LDH1), and the upper diameter (UD1) of the first embodiment. The junction between the lower diameter (LD2) and the upper diameter (UD2) forms a ridge 224.

The capillaries 222 have dividers 226 which intrude slightly into the capillaries 222 with the divider ends being preferably flush with the spinnerette face. In the embodiment of FIGS. 2A, 2B, and 2C, each capillary end 220 is divided in half by placing the divider 226 at the center of each capillary end 220. The width of the divider 226 (DW2) and the height of the divider 226 (DH2) are the same as the width of the divider (DW1) and the height of the divider (DH1) in the first embodiment.

To facilitate splitting of the molten polymer, the ratios of the first embodiment are also important in the second embodiment, the latter being essentially only a scaleup of the former. Therefore the corresponding ratios are preferably the same in the first and second embodiments.

Figure 3A:
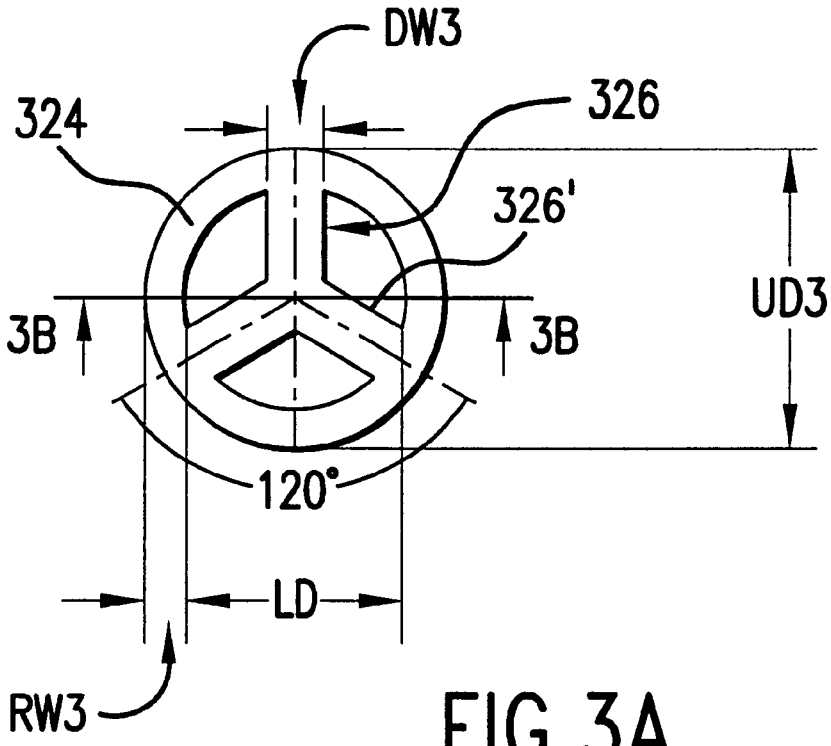
FIG. 3A is a top view of a capillary of a third embodiment of the present invention involving a 3-way split capillary in a short spin spinnerette.
Figure 3B:
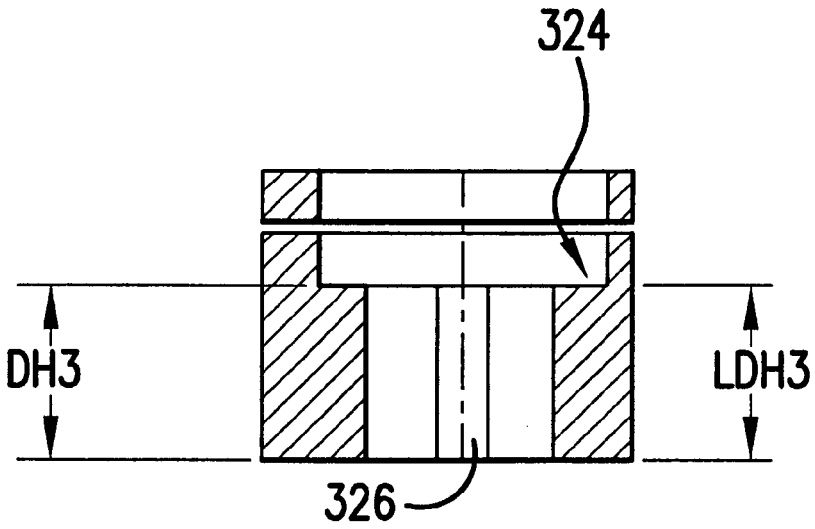
FIG. 3B is a schematic cross-section taken along line 3B of FIG. 3A of a capillary of the third embodiment of the present invention involving a 3-way split capillary.
Figure 3C:
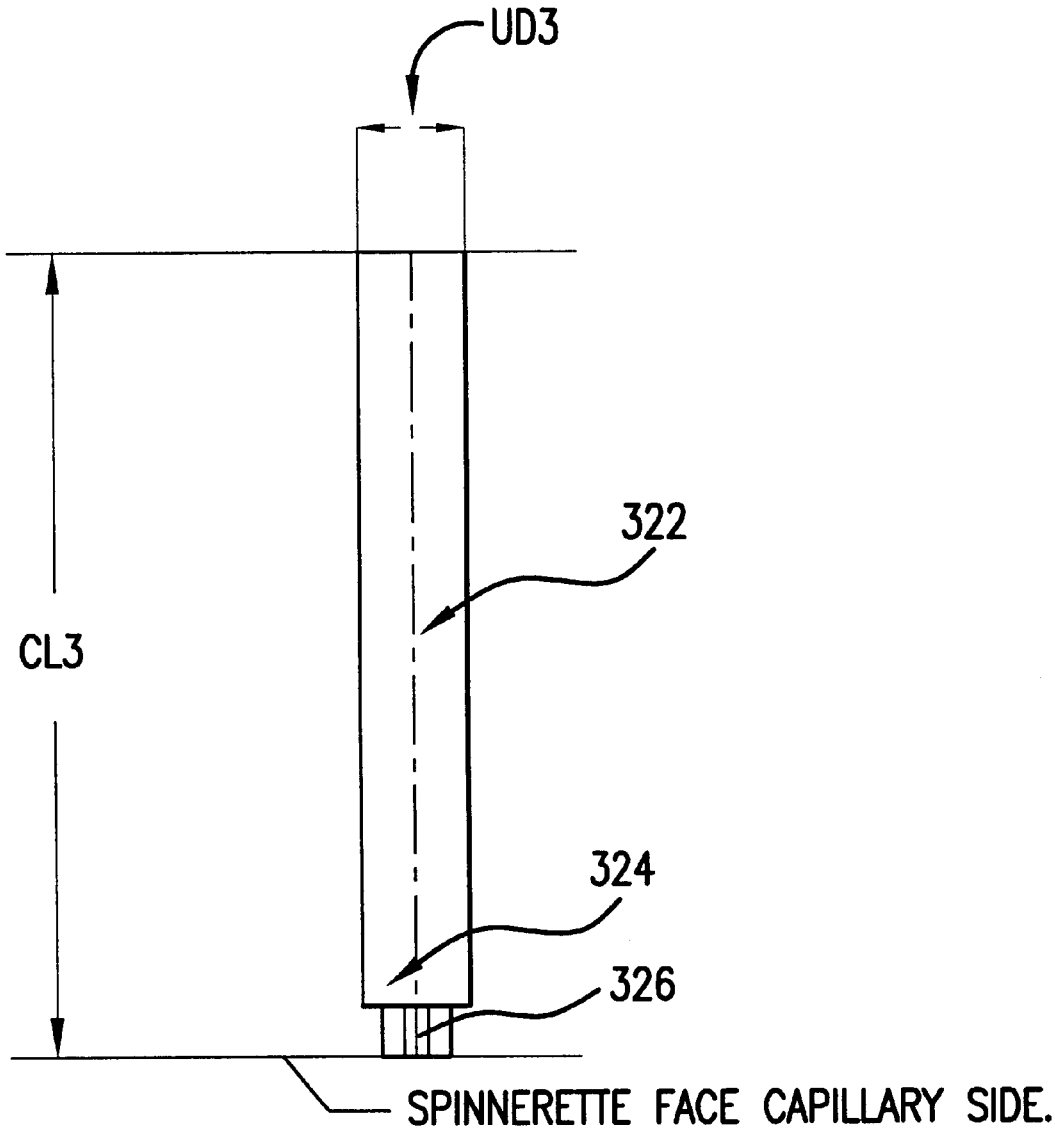
FIG. 3C is a cross-section also taken along line 3B of FIG. 3A of a capillary of the third embodiment of the present invention involving a 3-way split capillary.

FIGS. 3A, 3B, and 3C illustrate a third embodiment of the present invention involving a 3-way split capillary. Referring to FIG. 3C, the capillary 322 preferably has a length (CL3) which can be the same as that given above for CL1.

Referring to FIG. 3A, the capillary 322 has a lower diameter (LD3) of preferably about 0.8 to 1.3 mm, more preferably about 0.9 to 1.2 mm, and most preferably about 1.0 to 1.2 mm. The lower diameter (LD3) has a height (LDH3) of preferably about 0.6 to 2.5 mm, more preferably about 0.8 to 2 mm, and most preferably about 1 to 1.6 mm. The capillary 322 has an upper diameter (UD3) of preferably about 1 to 3 mm, more preferably about 1.5 to 2.5 mm, and most preferably about 2.0 to 2.2 mm.

The junction between the lower diameter (LD3) and the upper diameter (UD3) forms a ridge 324. The width of the ridge 324 (RW3) is preferably about 0.1 to 0.8 mm, more preferably about 0.15 to 0.6 mm, and most preferably about 0.2 to 0.4 mm.

The capillary 322 has a divider 326 which intrudes slightly into the capillary 322 with the divider end being preferably flush with the spinnerette face. In the embodiment of FIGS. 3A, 3B, and 3C, the capillary 322 is trisected by three divider segments 326' which join at the center of the capillary 322. The width of the divider segments 326' (DW3) is preferably at least about 0.2 mm for long spin setup and at least about 0.1 mm for short spin set up, more preferably about 0.2 to 0.5 mm for long spin setup and about 0.1 to 0.2 mm for short spin setup, and most preferably about 0.15 to 0.2 mm for short spin setup and about 0.25 to 0.3 mm for long spin setup.

The height of the divider 326 (DH3) is preferably greater than the height LDH3, and is preferably about 0.2 to 3.5 mm, more preferably about 0.4 to 2.5 mm, and most preferably about 0.5 to 2 mm, with one preferred value being about 1.2 mm.

Figure 4A:
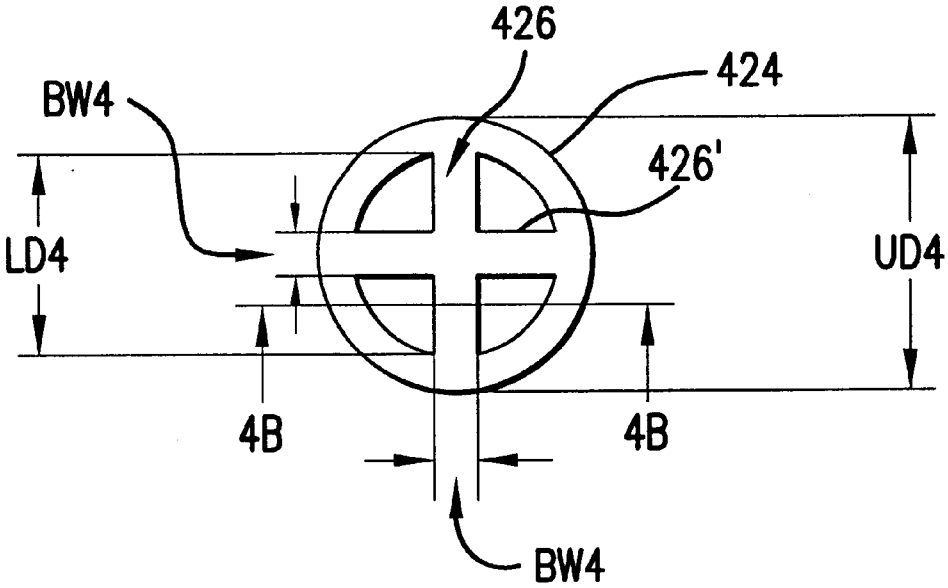
FIG. 4A is a top view of a capillary of a fourth embodiment of the present invention involving a 4-way split capillary in a short spin spinnerette.
Figure 4B:
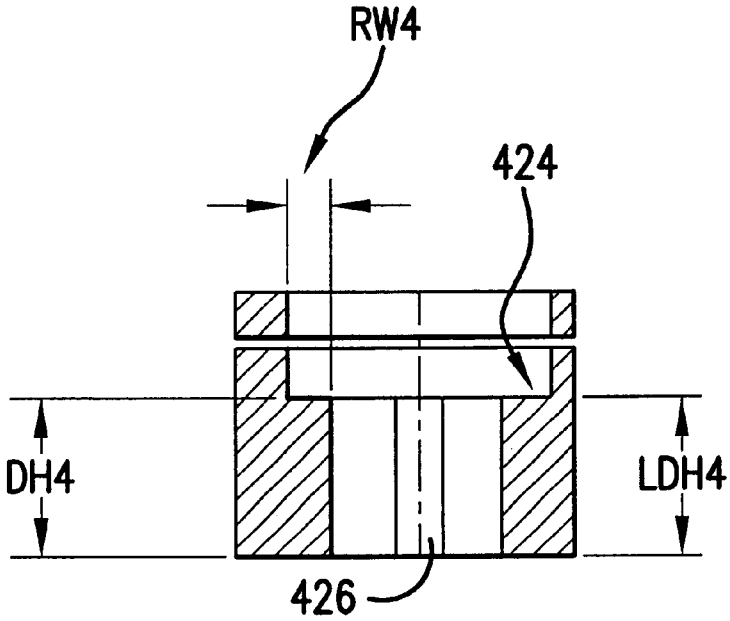
FIG. 4B is a schematic cross-section taken along line 4B of FIG. 4A of a capillary of the fourth embodiment of the present invention involving a 4-way split capillary.
Figure 4C:
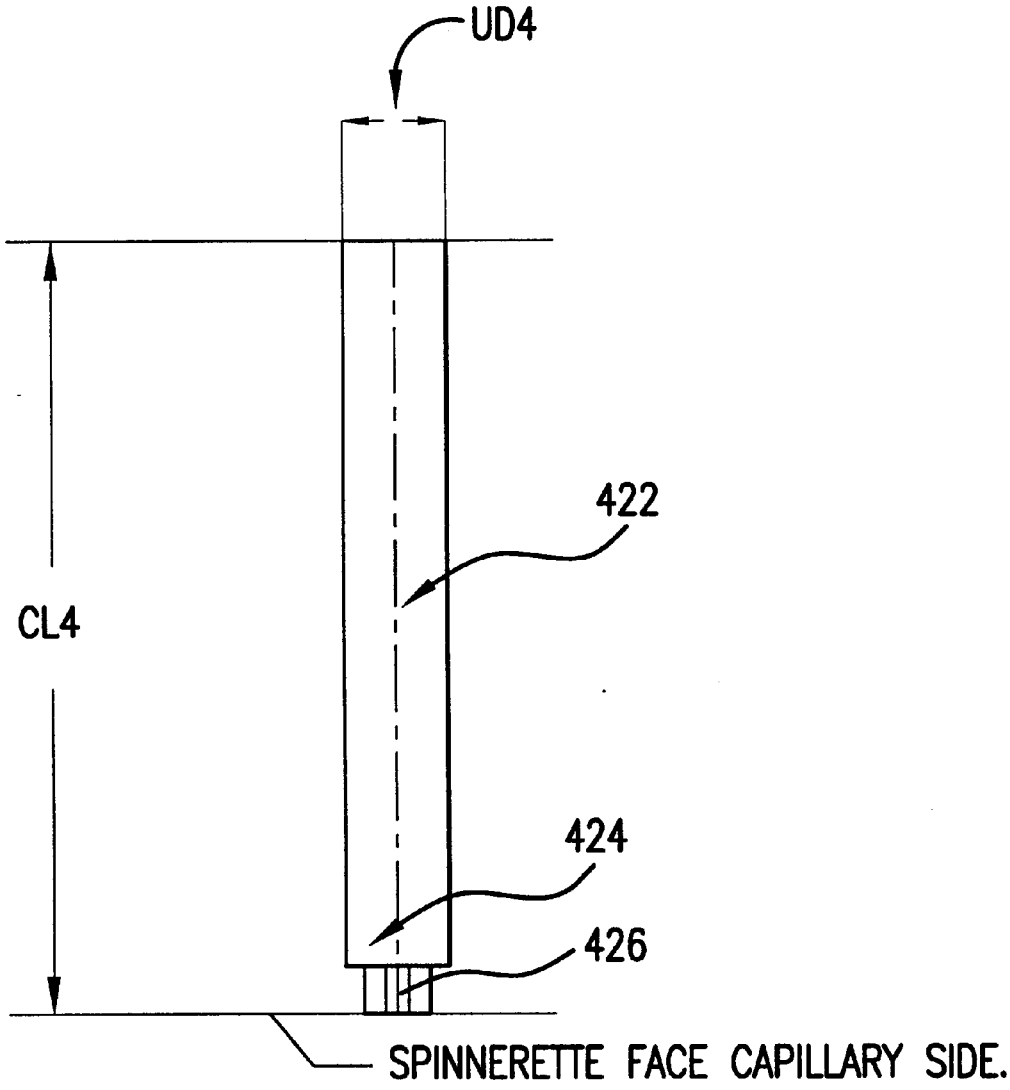
FIG. 4C is a cross-section also taken along line 4B of FIG. 4A of a capillary of the fourth embodiment of the present invention involving a 4-way split capillary.

FIGS. 4A, 4B, and 4C illustrate a fourth embodiment of the present invention involving a 4-way split capillary. Referring to FIG. 4C, the capillary 422 preferably has a length (CL4) similar to (CL1) described above. Referring to FIG. 4A, the capillary 422 preferably has a lower diameter (LD4) of preferably about 0.8 to 1.3 mm, more preferably about 0.9 to 1.2 mm, and most preferably about 1.0 to 1.2 mm. The capillary 422 has an upper diameter (UD4) of preferably about 1.0 to 3.0 mm, more preferably about 1.5 to 2.5 mm, and most preferably about 2.0 to 2.2 mm.

The junction between the lower diameter (LD4) and the upper diameter (UD4) forms a ridge 424. The width of the ridge 424 (RW4) is preferably about 0.1 to 0.8 mm, more preferably about 0.15 to 0.6 mm, and most preferably about 0.2 to 0.4 mm.

The capillary 422 has a divider 426 which intrudes slightly into the capillary 422 with the divider ends being preferably flush with the spinnerette face. In the embodiment of FIG. 4A, 4B, and 4C, the capillary 422 is quadrasected by four divider segments 426' which join at the center of the capillary 422. The width of the divider segments 426' (DW4) is preferably at least about 0.2 mm for long spin setup and at least about 0.1 mm for short spin set up, more preferably about 0.2 to 0.3 mm for long spin setup and about 0.1 to 0.2 mm for short spin setup, and most preferably about 0.15 to 0.2 mm for short spin setup and about 0.25 to 0.3 mm for long spin setup.

The height of the divider 426 (DH4) is preferably about 0.5 to 1.6 mm, more preferably about 0.6 to 1.4 mm, and most preferably about 0.8 to 1.2 mm.

Figure 5A:
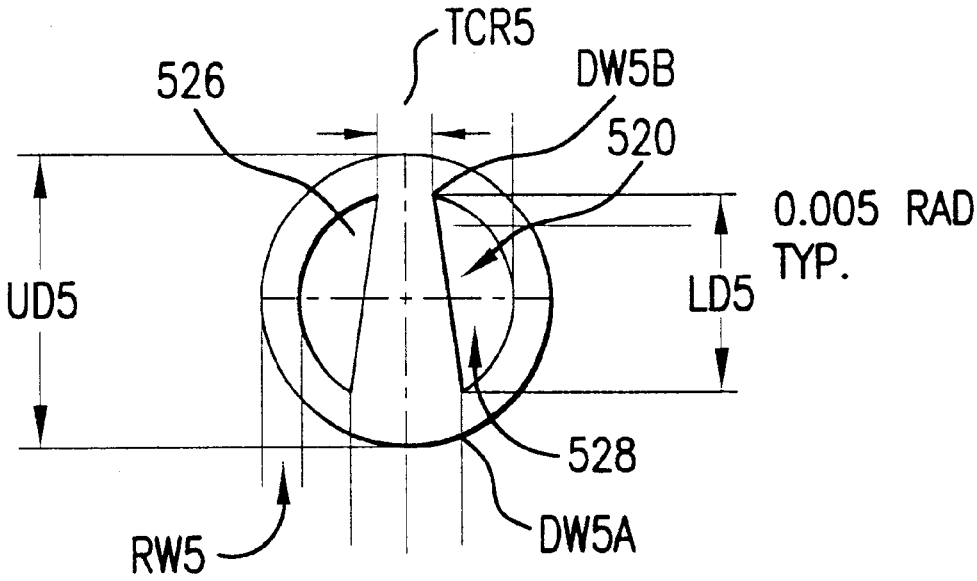
FIG. 5A is a bottom view of a fifth embodiment of a spinnerette according to the present invention involving a divided capillary which modifies fiber cross-section in a long spin spinnerette.
Figure 5B:
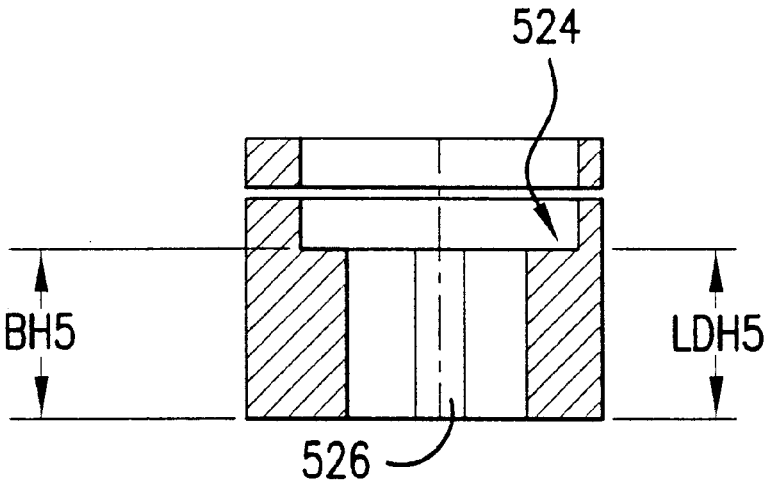
FIG. 5B is a cross-section taken along line 5B of FIG. 5A of a capillary of the fifth embodiment of the spinnerette of the present invention.
Figure 5C:
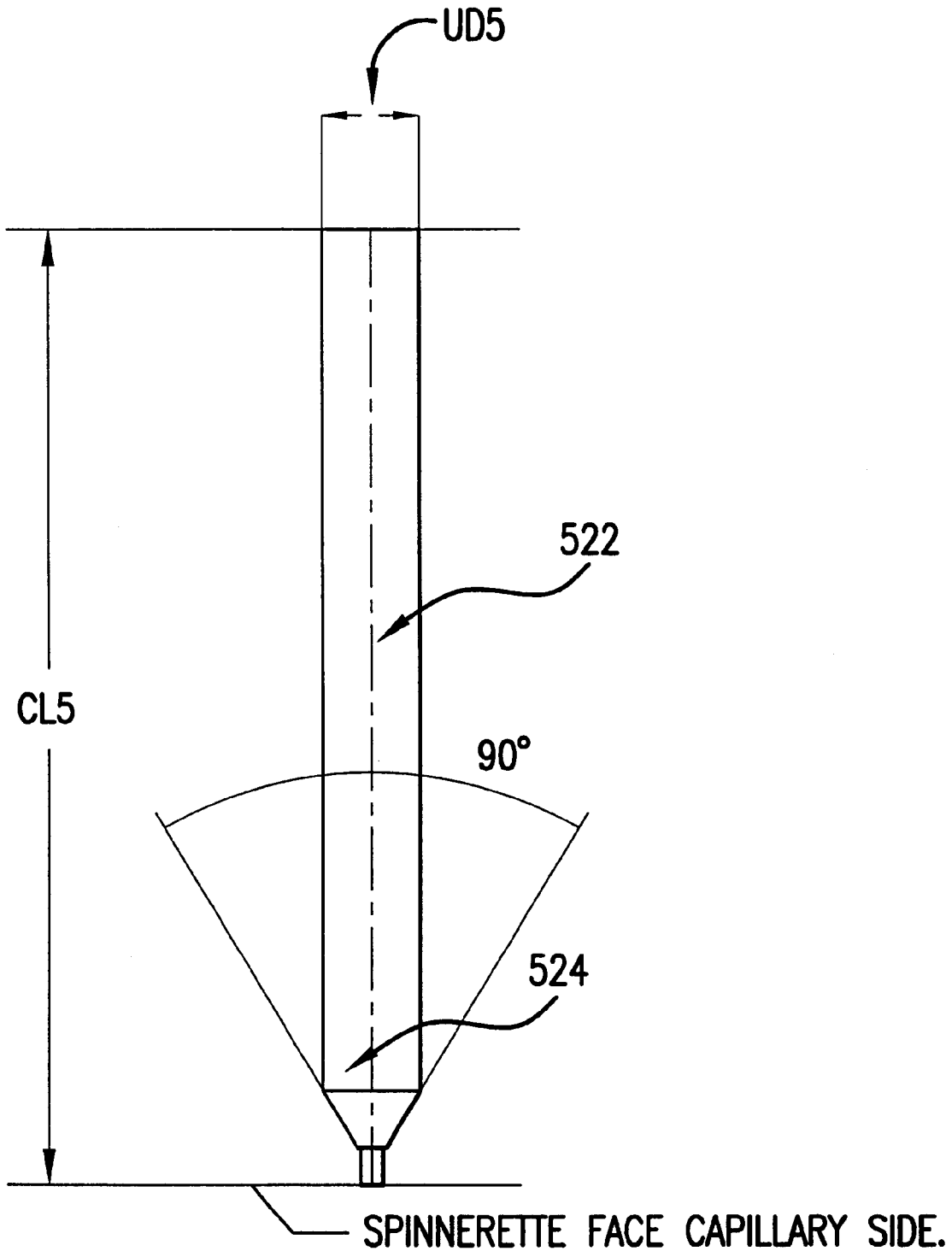
FIG. 5C is a bottom view of a capillary of the fifth embodiment of the spinnerette of the present invention.

FIGS. 5A, 5B, and 5C illustrate a fifth embodiment of the present invention involving a capillary that is split to produce a fiber having a fat C-shaped cross-section. In this embodiment the divider is tapered along its length to provide a greater stress at one end of the divider as compared to the opposite end. In this manner, the polymer is not evenly stressed along the length of the divider to completely separate filament exiting the capillary into individual filaments, but instead partially splits the polymer melt to modify the cross-section of the filament.

Referring to FIG. 5C, the capillary 522 preferably has a length (CL5) similar to that of (CL1). Referring to FIG. 5A, the capillary 522 preferably has a lower diameter (LD5) of preferably about 0.8 to 1.3 mm, more preferably about 0.9 to 1.2 mm, and most preferably about 1.0 to 1.2 mm. The capillary 522 has an upper diameter (UD5) of preferably about 1.0 to 3.0 mm, more preferably about 1.5 to 2.5 mm, and most preferably about 2.0 to 2.2 mm.

The junction between the lower diameter (LD5) and the upper diameter (UD5) forms a ridge 524. The width of the ridge 524 (RW5) is preferably about 0.1 to 1.5 mm, more preferably about 0.25 to 1.2 mm, and most preferably about 0.5 to 0.8 mm.

The capillary 522 has a divider 526 which intrudes slightly into the capillary 522 with the divider ends being preferably flush with the spinnerette face. In the embodiment of FIG. 5, each of the capillary ends 520 is divided in half by placing the divider 526 at the center of each capillary end 520. Alternatively, the dividers may be placed off-center in the spinnerette apertures. In this embodiment, as compared to the embodiment illustrated in FIG. 1, the divider 526 tapers from a width (DW5A) of preferably about 0.25 to 0.4 mm, and more preferably about 0.3 to 0.4 mm to a width (DW5B) of preferably about 0.1 to 0.3 mm, and more preferably about 0.1 to 0.2 mm, with one preferred width (DW5A) being 0.4 mm, and one preferred width (DW5B) being 0.2 mm. Similar, divider heights, dimensions and flow rates apply in this embodiment as in the previous embodiments, such as the embodiment illustrated in FIG. 1.

The spinnerette according to the present invention can be constructed with various materials, such as metals and metal alloys including stainless steel such as, e.g., stainless steel 17-4 PH, and stainless steel 431. One having ordinary skill in the art would be capable of manufacturing spinnerettes according to the present invention, such as using conventional laser technology.

The capillaries of the spinnerette according to the present invention preferably have a smoothness of preferably 15 to 40 root mean square (rms), more preferably 20 to 30 rms, measured according to NASI B46.1.

The fibers useful in accordance with the present invention can comprise various polymers. Thus, polymers useful with the present invention can comprise various spinnable polymeric materials such as polyolefins and blends comprising polyolefins. Useful polymers include those polymers as disclosed in U.S. Pat. Nos. 5,733,646, 5,888,438, 5,431,994, 5,318,735, 5,281,378, 5,882,562 and 5,985,193, the disclosures of which are incorporated by reference herein in their entireties.

Preferably, the polymer is a polypropylene or a blend comprising a polypropylene. The polypropylene can comprise any polypropylene that is spinnable. The polypropylene can be atactic, heterotactic, syndiotactic, isotactic and stereoblock polypropylene—including partially and fully isotactic, or at least substantially fully isotactic—polypropylenes. Polypropylenes which may be spun in the inventive system can be produced by any process. For example, the polypropylene can be prepared using Ziegler-Natta catalyst systems, or using homogeneous or heterogeneous metallocene catalyst systems.

Further, as used herein, the terms polymers, polyolefins, polypropylene, polyethylene, etc., include homopolymers, various polymers, such as copolymers and terpolymers, and mixtures (including blends and alloys produced by mixing separate batches or forming a blend in situ). When referring to polymers, the terminology copolymer is understood to include polymers of two monomers, or two or more monomers, including terpolymers. For example, the polymer can comprise copolymers of olefins, such as propylene, and these copolymers can contain various components. Preferably, in the case of polypropylene, such copolymers can include up to about 20 wt %, and, even more preferably, from about 0 to 10 wt % of at least one of ethylene and 1-butene. However, varying amounts of these components can be contained in the copolymer depending upon the desired fiber.

Further, the polypropylene can comprise dry polymer pellet, flake or grain polymers having a narrow molecular weight distribution or a broad molecular weight distribution, with a broad molecular weight distribution being preferred. The term "broad molecular weight distribution" is here defined as dry polymer pellet, flake or grain preferably having an MWD value (i.e., Wt.Av.Mol.Wt./No.Av.Mol.Wt. (Mw/Mn) measured by SEC as discussed below) of at least about 5, preferably at least about 5.5, more preferably at least about 6. Without limiting the invention, the MWD is typically about 2 to 15, more typically, less than about 10.

The resulting spun melt preferably has a weight average molecular weight varying from about $3\times10^5$ to about $5\times10^5$, a broad SEC molecular weight distribution generally in the range of about 6 to 20 or above, a spun melt flow rate, MFR (determined according to ASTM D-1238-86 (condition L; 230/2.16), which is incorporated by reference herein in its entirety) of about 13 to about 50 g/10 minutes, and/or a spin temperature conveniently within the range of about 220° to 315° C., preferably about 270° to 290° C.

Size exclusion chromatography (SEC) is used to determine the molecular weight distribution. In particular, high performance size exclusion chromatography is performed at a temperature of 145° C. using a Waters 150-C ALC/GPC high temperature liquid chromatograph with differential refractive index (Waters) detection. To control temperature, the column compartment, detector, and injection system are thermostatted at 145° C., and the pump is thermostatted at 55° C. The mobile phase employed is 1,2,4-trichlorobenzene (TCB) stabilized with butylated hydroxytoluene (BHT) at 4 mg/L, with a flow rate of 0.5 ml/min. The column set includes two Polymer Laboratories (Amherst, Mass.) PL Gel mixed-B bed columns, 10 micron particle size, part no. 1110-6100, and a Polymer Laboratories PL-Gel 500 angstrom column, 10 micron particle size, part no. 1110-6125. To perform the chromatographic analysis, the samples are dissolved in stabilized TCB by heating to 175° C. for two hours followed by two additional hours of dissolution at 145° C. Moreover, the samples are not filtered prior to the analysis. All molecular weight data is based on a polypropylene calibration curve obtained from a universal transform of an experimental polystyrene calibration curve. The universal transform employs empirically optimized Mark-Houwink coefficients of K and $\alpha$ of 0.0175 and 0.67 for polystyrene, and 0.0152 and 0.72 for polypropylene, respectively.

Still further, the polypropylene can be linear or branched, such as disclosed by U.S. Pat. No. 4,626,467 to HOSTETTER, which is incorporated by reference herein in its entirety, and is preferably linear. Additionally, in making the fiber of the present invention, the polypropylene to be made into fibers can include polypropylene compositions as taught in U.S. Pat. Nos. 5,629,080, 5,733,646 and 5,888,438 to GUPTA et al., and European Patent Application No. 0 552 013 to GUPTA et al., which are incorporated by reference herein in their entireties. Still further, polymer blends such as disclosed in U.S. Pat. No. 5,882,562 to KOZULLA, and European Patent Application No. 0 719 879, which are incorporated by reference herein in their entireties, can also be utilized. Yet further, polymer blends, especially polypropylene blends, which comprise a polymeric bond curve enhancing agent, as disclosed in U.S. Pat. No. 5,985,193 to HARRINGTON et al., and WO 97/37065, which are incorporated by reference herein in their entireties, can also be utilized.

The production of polymeric fibers for nonwoven materials usually involves the use of a mix of at least one polymer with nominal amounts of additives, such as antioxidants, stabilizers, pigments, antacids, process aids and the like. Thus, the polymer or polymer blend can include various additives, such as melt stabilizers, antioxidants, pigments, antacids and process aids. The types, identities and amounts of additives can be determined by those of ordinary skill in the art upon consideration of requirements of the product. Without limiting the invention, preferred antioxidants include phenolic antioxidants (such as "Irganox 1076", available from Ciba-Geigy, Tarrytown, N.Y.), and phosphite antioxidants (such as "Irgafos 168", also available from Ciba-Geigy, Tarrytown, N.Y.) which may typically be present in the polymer composition in amounts of about 50–150 ppm (phenolic) or about 50–1000 ppm (phosphite) based on the weight of the total composition. Other optional additives which can be included in the fiber of the present invention include, for example, pigments such as titanium dioxide, typically in amounts up to about 0.5 to 1 wt %, antacids such as calcium stearate, typically in amounts ranging from about 0.01 to 0.2 wt %, colorants, typically in amounts ranging from 0.01 to 2.0 wt %, and other additives.

Various finishes can be applied to the filaments to maintain or render them hydrophilic or hydrophobic. Finish compositions comprising hydrophilic finishes or other hydrophobic finishes, may be selected by those of ordinary skill in the art according to the characteristics of the apparatus and the needs of the product being manufactured.

Also, one or more components can be included in the polymer blend for modifying the surface properties of the fiber, such as to provide the fiber with repeat wettability, or to prevent or reduce build-up of static electricity. Hydrophobic finish compositions preferably include antistatic agents. Hydrophilic finishes may also include such agents.

Preferable hydrophobic finishes include those of U.S. Pat. No. 4,938,832, U.S. Pat. No. Re. 35,621, and U.S. Pat. No. 5,721,048, and European Patent Application No. 0 486,158, all to SCHMALZ, which are incorporated by reference herein in their entireties. These documents describe fiber finish compositions containing at least one neutralized phosphoric acid ester having a lower alkyl group, such as a 1–8 carbon alkyl group, which functions as an antistatic, in combination with polysiloxane lubricants.

Another hydrophobic finish composition that can be used with the present invention is disclosed in U.S. Pat. No. 5,403,426 to JOHNSON et al., which is incorporated by reference herein in its entirety. This patent describes a method of preparing hydrophobic fiber for processing inclusive of crimping, cutting, carding, compiling and bonding. The surface modifier comprises one or more of a class of water soluble compounds substantially free of lipophilic end groups and of low or limited surfactant properties.

Yet another hydrophobic finish composition that can be used with the present invention is disclosed in U.S. Pat. No. 5,972,497 to HIRWE et al., and WO 98/15685, which are incorporated by reference as if set forth in their entirety herein. The hydrophobic finish compositions of these documents comprise hydrophobic esters of pentaerythritol homologs, preferably hydrophobic esters of pentaerythritol and pentaerythritol oligomers. Finish compositions comprising such a lubricant may further comprise other lubricants, anti-static agents, and/or other additives.

Further, U.S. Pat. No. 5,540,953 to HARRINGTON, which is incorporated by reference herein in its entirety, describes antistatic compositions useful in the preparation of hydrophobic fibers and nonwoven fabrics. One finish described therein comprises: (1) at least one neutralized $C_3$–$C_{12}$ alkyl or alkenyl phosphate alkali metal or alkali earth metal salt; and (2) a solubilizer. A second finish described therein comprises at least one neutralized phosphoric ester salt.

An example of a suitable hydrophilic finish is ethoxylated fatty acid, LUROL PP912 and PG400 by Ghoulston, Charlotte, N.C.

Other ingredients that may be comprised in a finish composition useful with the present invention include emulsifiers or other stabilizers, and preservatives such as biocides. One preferred biocide is "Nuosept 95", 95% hemiacetals in water (available from Nuodex Inc. division of HULS America Inc., Piscataway, N.J.).

The fibers are preferably polypropylene fibers, and the polypropylene fibers can have a skin-core structure. Fibers with a skin-core structure can be produced by any procedure that achieves oxidation, degradation and/or lowering of molecular weight of the polymer blend at the surface of the fiber as compared to the polymer blend in an inner core of the fiber. Such a skin-core structure can be obtained, for example, through a delayed quench and exposure to an oxidative environment, such as disclosed in U.S. Pat. Nos. 5,431,994, 5,318,735, 5,281,378 and 5,882,562, all to KOZULLA, U.S. Pat. No. 5,705,119 and 6,116,883 to TAKEUCHI et al., U.S. Pat. No. 5,948,334, and European Application No. 719 879 A2, all of which are incorporated by reference herein in their entireties. One method of obtaining a skin-core structure involves employing a heated spinnerette to achieve thermal degradation of the filament surface, as disclosed in U.S. Pat. Nos. 5,705,119 and 6,116,883 to TAKEUCHI et al., which are incorporated by reference herein in their entireties. As discussed in U.S. Pat. No. 5,985,193 to HARRINGTON et al. and WO 97/37065, which are incorporated by reference herein in their entireties, the skin-core structure can comprise a skin showing an enrichment of ruthenium staining (discussed in more detail below) of at least about 0.2 $\mu$m, more preferably at least about 0.5 $\mu$m, more preferably at least about 0.7 $\mu$m, even more preferably at least about 1 $\mu$m, and most preferably at least about 1.5 $\mu$m. For instance, the polymeric fiber may have a denier per filament of less than 2 and have a skin-core structure comprising a skin showing a ruthenium staining enrichment of at least about 1% of an equivalent diameter of the polymeric fiber.

The skin-core structure comprises chemical modification of a filament to obtain the skin-core structure, and does not comprise separate components being joined along an axially extending interface, such as in sheath-core and side-by-side bicomponent fibers.

Thus, skin-core fibers can be prepared by providing conditions in any manner so that during extrusion of the polymer blend a skin-core structure is formed. For example, the temperature of a hot extrudate, such as an extrudate exiting a spinnerette, can be provided that is sufficiently elevated and for a sufficient amount of time within an oxidative atmosphere in order to obtain the skin-core structure. This elevated temperature can be achieved using a number of techniques, such as disclosed in the above discussed patents to KOZULLA, and in U.S. and foreign applications to TAKEUCHI et al., discussed above and incorporated by reference herein in their entireties.

For example, skin-core filaments can be prepared in the inventive system through the method of U.S. Pat. Nos. 5,281,378, 5,318,735 and 5,431,994 to KOZULLA, U.S. Pat. No. 5,985,193 to HARRINGTON et al., and U.S. Pat. No. 5,882,562 to KOZULLA and European Patent Application No. 719 879 A2, the disclosures of which are herein incorporated by reference, in which the temperature of the hot extrudate can be provided above at least about 250° C. in an oxidative atmosphere for a period of time sufficient to obtain the oxidative chain scission degradation of its surface. This providing of the temperature can be obtained by delaying cooling of the hot extrudate as it exits the spinnerette, such as by blocking the flow of a quench gas reaching the hot extrudate. Such blocking can be achieved by the use of a shroud or a recessed spinnerette that is constructed and arranged to provide the maintaining of temperature.

The oxidative chain scission degraded polymeric material may be substantially limited to a surface zone, and the inner core and the surface zone may comprise adjacent discrete portions of said skin-core structure. Further, the fiber may have a gradient of oxidative chain scission degraded polymer material between the inner core and the surface zone. The skin-core structure may comprise an inner core, a surface zone surrounding the inner core, wherein the surface zone comprises an oxidative chain scission degraded polymeric material, so that the inner core and the surface zone define the skin-core structure, and the inner core has a melt flow rate substantially equal to an average melt flow rate of the polymeric fiber. The skin-core structure may comprise an inner core having a melt flow rate, and the polymeric fiber has an average melt flow rate about 20 to 300% higher than the melt flow rate of the inner core.

In another aspect, as disclosed in U.S. Pat. Nos. 5,705,119 and 6,116,883 to TAKEUCHI et al., and European Patent Application No. 0 630 996, the skin-core structure can be obtained by heating the polymer blend in the vicinity of the spinnerette, either by directly heating the spinnerette or an area adjacent to the spinnerette. In other words, the polymer blend can be heated at a location at or adjacent to the at least one spinnerette, by directly heating the spinnerette or an element such as a heated plate positioned approximately 1 to 4 mm above the spinnerette, so as to heat the polymer composition to a sufficient temperature to obtain a skin-core fiber structure upon cooling, such as being immediately quenched, in an oxidative atmosphere.

In an application of the TAKEUCHI system to the present invention, for example, the extrusion temperature of the polymer may be about 230° C. to 250° C., and the spinnerette may have a temperature at its lower surface of preferably at least about 250° C. across the exit of the spinnerette in order to obtain oxidative chain scission degradation of the molten filaments to thereby obtain filaments having a skin-core structure. By the use of a heated spinnerette, therefore, the polymer blend is maintained at a sufficiently high temperature that upon extrusion from the spinnerette, oxidative chain scission occurs under oxidative quench conditions.

While the above techniques for forming the skin-core structure have been described, skin-core fibers prepared in the inventive system are not limited to those obtained by the above-described techniques. Any technique that provides a skin-core structure to the fiber is included in the scope of this invention.

In order to determine whether a skin-core fiber is present, a ruthenium staining test is utilized. As is disclosed in the above-noted U.S. and European applications to TAKEUCHI et al., which are incorporated by reference herein in their entirety, the substantially non-uniform morphological structure of the skin-core fibers according to the present invention can be characterized by transmission electron microscopy (TEM) of ruthenium tetroxide ($RuO_4$)-stained fiber thin sections. In this regard, as taught by TRENT et al., in *Macromolecules*, Vol. 16, No. 4, 1983, "Ruthenium Tetroxide Staining of Polymers for Electron Microscopy", which is hereby incorporated by reference in its entirety, it is well known that the structure of polymeric materials is dependent on their heat treatment, composition, and processing, and that, in turn, mechanical properties of these materials such as toughness, impact strength, resilience, fatigue, and fracture strength can be highly sensitive to morphology. Further, this article teaches that transmission electron microscopy is an established technique for the characterization of the structure of heterogeneous polymer systems at a high level of resolution; however, it is often necessary to enhance image contrast for polymers by use of a staining agent. Useful staining agents for polymers are taught to include osmium tetroxide and ruthenium tetroxide. For the staining of the fibers of the present invention, ruthenium tetroxide is the preferred staining agent.

In the morphological characterization of the present invention, samples of fibers are stained with aqueous $RuO_4$, such as a 0.5% (by weight) aqueous solution of ruthenium tetroxide obtainable from Polysciences, Inc., Warrington, Pa. overnight at room temperature. (While a liquid stain is utilized in this procedure, staining of the samples with a gaseous stain is also possible.) Stained fibers are embedded in Spurr epoxy resin and cured overnight at 60° C. The embedded stained fibers are then thin sectioned on an ultramicrotome using a diamond knife at room temperature to obtain microtomed sections approximately 80 nm thick, which can be examined on conventional apparatus, such as a Zeiss EM-10 TEM, at 100 kV. Energy dispersive X-ray analysis (EDX) was utilized to confirm that the $RuO_4$ had penetrated completely to the center of the fiber.

According to the present invention, the ruthenium staining test would be performed to determine whether a skin-core structure is present in a fiber. More specifically, a fiber can be subjected to ruthenium staining, and the enrichment of ruthenium (Ru residue) at the outer surface region of the fiber cross-section would be determined. If the fiber shows an enrichment in the ruthenium staining for a thickness of at least about 0.2 $\mu$m or at least about 1% of the equivalent diameter for fibers having a denier of less than 2, the fiber has a skin-core structure.

While the ruthenium staining test is an excellent test for determining skin-core structure, there may be certain instances wherein enrichment in ruthenium staining may not occur. For example, there may be certain components within the fiber that would interfere with or prevent the ruthenium from showing an enrichment at the skin of the fiber, when, in fact, the fiber comprises a skin-core structure. The description of the ruthenium staining test herein is in the absence of any materials and/or components that would prevent, interfere with, or reduce the staining, whether these materials are in the fiber as a normal component of the fiber, such as being included therein as a component of the processed fiber, or whether these materials are in the fiber to prevent, interfere with or reduce ruthenium staining.

Also, with fibers having a denier less than 2, another manner of stating the ruthenium enrichment is with respect to the equivalent diameter of the fiber, wherein the equivalent diameter is equal to the diameter of a circle with equivalent cross-section area of the fiber averaged over five samples. More particularly, for fibers having a denier less than 2, the skin thickness can also be stated in terms of enrichment in staining of the equivalent diameter of the fiber. In such an instance, the enrichment in ruthenium staining can comprise at least about 1% and up to about 25% of the equivalent diameter of the fiber, preferably about 2% to 10% of the equivalent diameter of the fiber.

Another test procedure to illustrate the skin-core structure of the fibers of the present invention, and especially useful in evaluating the ability of a fiber to thermally bond, consists of the microfusion analysis of residue using a hot stage test, as disclosed in U.S. Pat. Nos. 5,705,119 and 6,116,883 to TAKEUCHI, which are incorporated herein by reference in their entireties. This procedure is used to examine for the presence of a residue following axial shrinkage of a fiber during heating, with the presence of a higher amount of residue directly correlating with the ability of a fiber to provide good thermal bonding.

In this hot stage procedure, a suitable hot stage, such as a Mettler FP82 HT low mass hot stage controlled via a Mettler FP90 control processor, is set to 145° C. A drop of silicone oil is placed on a clean microscope slide. Approximately 10 to 100 fibers are cut into ½ mm lengths from three random areas of filamentary sample, and stirred into the silicone oil with a probe. The randomly dispersed sample is covered with a cover glass and placed on the hot stage, so that both ends of the cut fibers will, for the most part, be in the field of view. The temperature of the hot stage is then raised at a rate of 3° C./minute. At temperatures between 160 and 162° C., the fibers shrink axially, and the presence or absence of trailing residues is observed. As the shrinkage is completed, the heating is stopped, and the temperature is reduced rapidly to 145° C. The sample is then examined through a suitable microscope, such as a Nikon SK-E trinocular polarizing microscope, and a photograph of a representative area is taken to obtain a still photo reproduction using, for example, a MTI-NC70 video camera equipped with a Pasecon videotube and a Sony Up-850 B/W videographic printer. A rating of "good" is used when the majority of fibers leaves residues. A rating of "poor" is used when only a few percent of the fibers leave residues. Other comparative ratings are also available, and include a rating of "fair" which falls between "good" and "poor", and a rating of "none" which, of course, falls below "poor". A rating of "none" indicates that a skin is not present, whereas ratings of "poor" to "good" indicate that a skin is present.

The fibers of the present invention can have any cross-sectional configuration, such as oval, circular, diamond, delta, trilobal—"Y"-shaped, "X"-shaped, and concave delta, wherein the sides of the delta are slightly concave. Apparently the cross-section of the fiber is dictated by the way it has been split before. Preferably, the fibers include a circular or a concave delta cross-section configuration. The cross-sectional shapes are not limited to these examples, and can include other cross-sectional shapes. Additionally, the fibers can include hollow portions, such as a hollow fiber, which can be produced, for example, with a "C" cross-section spinnerette.

An advantage of the present invention is the ability to make small denier fibers without sacrificing production rate. The size of the resulting fibers is preferably about 1.5 to 0.5 dpf, more preferably about 1.25 to 0.5 dpf, and most preferably about 1.0 to 0.5 dpf.

The throughput of polymer per capillary depends upon the desired size of the fibers, and also on the setup, i.e., short spin or long spin. For example for a 2.2 denier fiber the throughput generally is preferably about 0.2 to 0.8 g/min/capillary for long spin setup and about 0.02 to 0.05 g/min/capillary for short spin setup.

It is also preferred that the fiber of the present invention have a tenacity of less than about 3 g/denier, and a fiber elongation of at least about 100%, and more preferably a tenacity less than about 2.5 g/denier, and a fiber elongation of at least about 200%, and even more preferably a tenacity of less than about 2 g/denier, and an elongation of at least about 250%, as measured on individual fibers using a Fafegraph Instrument, Model T or Model M, from Textechno, Inc., which is designed to measure fiber tenacity and elongation, with a fiber gauge length of about 1.25 cm and an extension rate of about 200%/min (average of 10 fibers tested).

The cohesion of the fibers of the invention depends on the intended end use. The test utilized in the examples below to measure the cohesion of the fibers is ASTM D-4120-90, which is incorporated by reference herein in its entirety. In this test, specific lengths of roving, sliver or top are drafted between two pairs of rollers, with each pair moving at a different peripheral speed. The draft forces are recorded, test specimens are then weighed, and the linear density is calculated. Drafting tenacity, calculated as the draft resisting force per unit linear density, is considered to be a measure of the dynamic fiber cohesion.

More specifically, a sample of thirty (30) pounds of processed staple fiber is fed into a prefeeder where the fiber is opened to enable carding through a Hollingsworth cotton card (Model CMC (EF38-5) available from Hollingsworth on Wheels, Greenville, S.C.). The fiber moves to an even-feed system through the flats where the actual carding takes place. The fiber then passes through a doffmaster onto an apron moving at about 20 m/min. The fiber is then passed through a trumpet guide, then between two calender rolls. At this point, the carded fiber is converted from a web to a sliver. The sliver is then passed through another trumpet guide into a rotating coiler can. The sliver is made to 85 grains/yard.

From the coiler can, the sliver is fed into a Rothchild Dynamic Sliver Cohesion Tester (Model #R-2020, Rothchild Corp., Zurich, Switzerland). An electronic tensiometer (Model #R-1191, Rothchild Corp.) is used to measure the draft forces. The input speed is 5 m/min, the draft ratio is 1.25, and the sliver is measured over a 2 minute period. The overall force average divided by the average grain weight equals the sliver cohesion. Thus, the sliver cohesion is a measure of the resistance of the sliver to draft.

The resulting fibers may be used with or without mechanical crimping. For air-laid method of forming unbonded webs, fine deineir self-crimping fiber is especially advantageous.

The fibers of the present invention have a CPI of generally about 15 to 40 CPI, depending on the fiber cohesion required for the desired end use. CPI is determined herein by mounting thirty 1.5 inch fiber samples to a calibrated glass plate, in a zero stress state, the extremities of the fibers being held to the plate by double coated cellophane tape. The sample plate is then covered with an uncalibrated glass plate and the kinks present in a 0.625 inch length of each fiber are counted. The total number of kinks in each 0.625 inch length is then multiplied by 1.6 to obtain the crimps per inch for each fiber. Then, the average of 30 measurements is taken as CPI.

As previously noted, the fibers of the present invention may be used to make spunbonded nonwoven fabrics. Also as previously noted, the fibers of the present invention may be used to make cardbonded nonwoven fabrics.

Since it is not necessary to draw or heat the self-crimping fiber, an advantage of the self-crimping fiber is that the spun fiber's molecular structures and fiber orientations are maintained. Another advantage of self-crimping fibers is cost saving resulting from eliminating draw processing equipment and operating costs. Still another advantage of the self-crimping fiber is that it is possible to mechanically crimp without any draw.

The unmechanically crimped fiber, however, was unable to be run on some bonding lines. In particular, in some cases, the carded web emerging from the doffer, partially wrapped back onto the doffer cylinder, resulting in a distorted carded web. It is speculated that traditional carding machines are designed to handle fiber with sharp crimps made by a mechanical crimper, but not the smooth crimps of the self-crimping fiber.

Although drawing is not necessary, the fibers of the present invention can be drawn under various draw conditions, and preferably are drawn at ratios of about 1 to 4 times, with preferred draw ratios comprising about 1 to 2.5 times, more preferred draw ratios comprising about 1 to 2 times, more preferred draw ratios comprising from about 1 to 1.6 times, and still more preferred draw ratios comprising from about 1 to 1.4 times, with specifically preferred draw ratios comprising about 1.15 times to about 1.35 times. The draw ratio is the ratio of spun fiber denier to that of the final fiber after processing. For example, if the spun fiber denier is 3.0 and the final denier after processing is 2.2, the draw ratio is 1.36.

The fibers of the present invention can be processed on high speed machines for the making of various materials, in particular, nonwoven fabrics that can have diverse uses, including cover sheets, acquisition layers and back sheets in diapers. The fibers of the present invention enable the production of nonwoven materials at speeds as high as about 500 ft/min, more preferably as high as about 700 to 800 ft/min, and even as more preferably as high as about 980 ft/min (about 300 meters/min) or higher, such as about 350 meters/min, at basis weights from about 15 g/yd$^2$ (gsy) to 50 gsy, more preferably 20–40 gsy. Because of the fineness of the fibers, the fibers of the present invention are particularly useful in nonwoven fabrics having basis weights of less than about 20 g/yd$^2$, less than about 18 g/yd$^2$, less than about 17 g/yd$^2$, less than about 15 g/yd$^2$, or less than about 14 g/yd$^2$, with a range of about 14 to 20 g/yd$^2$.

The nonwoven materials preferably have cross-directional strengths, for a basis weight of about 20 gsy, of the order of at least about 200 g/in, more preferably 300 to 400 g/in, preferably greater than about 400 g/in, and more preferably as high as about 650 g/in, or higher. Further, the fabrics usually have an elongation of about at least about 80%, more preferably at least about 100%, even more preferably at least about 110%, even more preferably at least about 115%, even more preferably at least about 120%, even more preferably at least about 130%, and even more preferably at least about 140%.

As discussed above, the present invention involves nonwoven materials including the fibers described above which may be thermally bonded together. In particular, by incorporating the skin-core fibers described above into nonwoven materials, the resulting nonwoven materials possess exceptional cross-directional strength, softness, and elongation properties. More specifically, at a given fabric weight of 20 gsy, the resulting nonwoven materials have a cross-directional strength of preferably about 400 to 700 g/inch, more preferably about 500 to 700 g/inch, and most preferably about 650 to 700 g/inch. The nonwovens have a softness of preferably about 1.5 to 2.5 PSU, more preferably about 2.0 to 2.5 PSU, and most preferably about 2.25 to 2.5 PSU. The nonwovens have an elongation of preferably about 100 to 130%, more preferably about 115 to 130%, and most preferably about 120 to 130%. Further, the nonwovens have a machine direction strength of preferably about 1,500 to 4,000 g/in for a fabric 24 g/m$^2$, more preferably about 2,500 to 3,500 g/in for a fabric 24 g/m$^2$.

The nonwoven materials of the present invention can be used as at least one layer in various products, including hygienic products, such as sanitary napkins, incontinence products and diapers, comprising at least one liquid absorbent layer and at least one nonwoven material layer of the present invention and/or incorporating fibers of the present invention. Further, as previously indicated, the articles according to the present invention can include at least one liquid permeable or impermeable layer. For example, a diaper incorporating a nonwoven fabric of the present invention would include, as one embodiment, an outermost impermeable or permeable layer, an inner layer of the nonwoven material, and at least one intermediate absorbent layer. Of course, a plurality of nonwoven material layers and absorbent layers can be incorporated in the diaper (or other hygienic product) in various orientations, and a plurality of outer permeable and/or impermeable layers can be included for strength considerations.

Further, the nonwovens of the present invention can include a plurality of layers, with the layers being of the same fibers or different. Further, not all of the layers need include skin-core fibers of the polymer blend described above. For example, the nonwovens of the present invention can be used by themselves or in combination with other nonwovens, or in combination with other nonwovens or films.

The nonwoven material preferably has a basis weight of less than about 24 g/m$^2$ (gsm), more preferably less than about 22 g/m$^2$, more preferably less than about 20 g/m$^2$, even more preferably less than about 18 g/m$^2$, more preferably less than about 17 g/m$^2$, and even as low as 14 g/m$^2$, with a preferred range being about 17 to 24 g/m$^2$.

The fibers of the present invention can be very fine which makes them particularly suitable for application in filtration media and textile apparel. Moreover they are most suited for use in air-laid liquid absorbent products. At a given fabric weight the fine fibers of the present invention can cover a given area better and so the appearance thereof is better. Additionally, since in a given area more fibers are present in the case of the fine fibers of the present invention, the strength of a fabric at a given fabric weight is higher.

The present invention will be further illustrated by way of the following Examples. These examples are non-limiting and do not restrict the scope of the invention.

Unless stated otherwise, all percentages, parts, etc. presented in the examples are by weight.

EXAMPLES

Examples 1–6

The following Examples 1–6 involve a short spin setup with use of a relatively small electrically heated 2-way split rectangular spinnerette having 24 holes (6×4) as shown in FIGS. 1A–1C.

These Examples involve a polypropylene having a bimodal distribution with broad MWD of about 6 measured by SEC, a nominal MFR of 9 to 10.5 g/10 min and a MW of about 250,000, P165 obtained from Montell, Houston, Tex., now known as Bassell, including 0.05% Irgafos 168. Further, the spinning speed (measured at the take-up roll) for these Examples was set at 75 m/min.

The extruder used for these Examples was a ¾" extruder available from C.W. Brabender Instruments, Inc., South Hackensack, N.J. The extruder comprised five zones, i.e., a feed zone (zone 1), a transition zone (zone 2), a melting zone (zone 3) and two metering zones (zones 4 and 5). The temperature set points were 215° C. for zone 1, 215° C. for zone 2, and 284° C. for the elbow and spinhead temperature of 290° C.

One position, i.e., a single spinnerette, was used with the spinnerette having 23 capillaries. The spinnerette used in these Examples was similar to the spinnerettes shown in FIGS. 1A–1C, with the capillaries having dimensions of (DW1)=0.10 mm, (UD1)=0.60 mm, (LD1)=0.50 mm, (RW1)=0.05 mm, (DH1)=0.50 mm, (LDH1)=0.50 mm, and (CL1)=3.0 mm.

The spinnerette was heated by electrical resistance heating and the temperature of the spinnerette was varied, as listed in Table 1 below.

The throughput of polymer was varied, with the throughputs being listed in g/min/capillary in Table 1.

The spinnerette was mounted on a short spin setup. In particular, the quench was set at 4.5 psi of air at a chamber set point of 65° C. (A system was used wherein a blow motor builds up pressure in a settling chamber from which regulated air is released to attain the required quench rate. The high pressure air travels down to a conduit to exhaust through a quench nozzle having a gap width of 15 mm.) The average quench air velocity in these examples was of the order of 1000 ft/min.

Various spinnerette and polymer temperatures were explored on this setup, as listed in Table 1 below. Further, two target deniers were examined. In Examples 1–3, the target denier was 4.0 denier split into 2.0 denier. In Examples 4–6, the target denier was 2.0 denier split into 1.0 denier. In Table 1, "Pot" is the pump setting (pump setting for setting input voltage to metering pump) and Δp is the change in pressure between the exit of the extruder and the head of the spinnerette.

TABLE 1

| Ex. | Throughput (g/min/capillary) | Heating Current for Spinnerette (amps) | Target Fiber Size (dpf) (total denier/ actual fiber denier) | Spinnerette Surface Temp. (° C.) | Δp (psi) | Pot Setting | Pump (rpm) |
|---|---|---|---|---|---|---|---|
| 1 | 0.035 | 155 | 4/2 | 224.7 | 421 | 1.63 | 5.2 |
| 2 | 0.035 | 202 | 4/2 | 282.1 | 368 | 1.63 | 5.2 |
| 3 | 0.035 | 221 | 4/2 | 302.3 | 353 | 1.63 | 5.2 |
| 4 | 0.017 | 156 | 2/1 | 224.2 | 353 | 0.85 | 2.32 |
| 5 | 0.017 | 200 | 2/1 | 275 | 313 | 0.85 | 2.25 |
| 6 | 0.017 | 226 | 2/1 | 306.8 | 281 | 0.85 | 2.25 |

In Examples 1–6, a thermocouple was placed on the exposed surface of the spinnerette to measure the surface temperature of the spinnerette. The extruder zone temperatures for the above experiments as measured by thermocouples are listed in Table 2 below.

TABLE 2

| Ex. | T1 (Zone 2) (° C.) | T2 (Zone 3) (° C.) | T3 (Zone 4) (° C.) | T4 (Zone 5) (° C.) | T5 (Elbow) (° C.) |
|---|---|---|---|---|---|
| 1 | 282.2 | 290.8 | 290.2 | 296.8 | 291.6 |
| 2 | 281.4 | 289.8 | 290.2 | 296.4 | 295.2 |
| 3 | 282.4 | 291.6 | 290.2 | 296.2 | 297.2 |
| 4 | 281.2 | 289.2 | 290.2 | 297.0 | 292.2 |
| 5 | 281.6 | 289.4 | 290.2 | 296.8 | 294.6 |
| 6 | 282.8 | 292.4 | 290.2 | 296.6 | 296.4 |

For most of the cases examined, it was possible to spin satisfactorily. A skin-core structure was confirmed by examination by hot stage microscopy. Example 2 shows 90% split and Example 3 shows 50% split upon microscopic examination.

The filaments of Example 4 were examined under a microscope and it was found that they were split into two fibers having a substantially half-circular cross-section. The fibers of Example 4 were also examined under a hot stage microscope to look for skin formation. Examination by hot stage microscopy indicated that these fibers probably had a skin-core structure.

Examination by microscope of the cross-section of fibers of Examples 3 and 6, i.e., fibers made with the spinnerette at a relatively high temperature, showed that the fibers tend to merge together after initially splitting with the result being many fat single fibers. Each of these fibers has a distinct crease in the center, but is not split.

The filaments of Examples 1 and 4 had the properties listed in Table 3 below.

TABLE 3

| Example | dpf | Tenacity (g/denier) | Fiber Elongation (%) |
|---|---|---|---|
| 1 | 2.20 | 1.54 | 389.36 |
| 4 | 0.95 | 1.80 | 254.33 |

It must be remembered that a smaller denier fiber cannot be stretched as much as a larger denier fiber. Therefore, the elongation number must be compared accordingly.

Example 7 and Comparative Examples 1–4

The following Example 7 was run using the spinnerette and polymer as described in Examples 1–6 and Comparative Examples 1–4 involve a short spin setup with use of a relatively large, eclectically heated 2-way split spinnerette, Example 7 and the Comparative Examples of Table 4 all involve 2.2 dpf fibers made from a polypropylene having a broad MWD and a nominal MFR of about 9 (P165 including 0.05% Irgafos 168 as in the examples above). Further, the line speed for Example 7 was 44 m/min.

The extruder used in these experiments was a 2.5" Davis-Standard (Pawcatuck, Conn.) comprising 12 zones. The temperature set points were 214° C., 240° C., 240° C., 240° C., 240° C., 240° C., 215° C., 240° C., 240° C., 240° C., 240° C., and 240° C. for zones 1–12 of the extruder. The transfer pipe temperature was set to 240° C. and the spin head was heated by DOWTHERM (Dow Chemical, Midland, Mich.). This resulted in a spin head melt temperature of 242° C.

A spinnerette with 12,700 holes and a capillary diameter of 0.6 mm and a divider having a width of 0.1 mm was used in Example 7.

The spinnerette was heated by electrical resistance heating. The power input to the spinnerette was 3.5 KW. The spin head set point was 240° C. and the spinnerette temperature was between 219 and 225° C.

The throughput was 94 lb/hr. This throughput converts to 0.056 g/min/capillary.

The spinnerette was mounted on a short spin setup. In particular, the quench was set at 4.5 psi of air with a set point of 61.7° C. at the settling chamber.

Since the spun fiber was self-crimping it was possible to crimp without pre-drawing by use of a pair of draw rolls. The fiber tow by-passed two sets of septet rolls and fed directly into a crimper.

Comparative Example 1 was also prepared using a short spin mode, but with spinnerettes having a radial shape. The line had 12 positions, each comprising a spinnerette with 65,000 holes. The system was manufactured by Meccaniche (Busto Arsizo, Italy). The spinning speed for this fiber was 133 m/min.

After the fibers were quenched, the speed of the tow of filaments from the spinnerette was set at 134.5 m/min. A first septet of rolls was set at 122° F. and at a speed of 134.9 m/min. A second septet of rolls was set at 190° F. and at a speed of 155.0 m/min. Thus, the draw ratio was set at 1.15 (=155.0/134.5).

After passing through the first and second septets, the tow was passed through a dancer roll whose pressure was set at 25 psi. From the dancer roll, the tow passed through a precrimper steam chest at a pressure of 25 psi. Once the tow had passed through the precrimper, it entered the crimper. After passing through the crimper, the tow was sent to a cutter and then to a baler.

The only difference between Comparative Example 1 and Comparative Example 2 was that Comparative Example 1 did not use a precrimper steam chest. Comparative Example 3 was run similar to Comparative Example 1, but the second septet temperature was reduced by 20° F. to 170° F. Comparative Example 4 (current production) was prepared by use of a slightly different raw material composition with the extruder temperature set point increased by about 10° C. throughout the zones.

The fiber of Example 7 was self-crimping. Table 4 below shows the results of crimp measurements, and compares the characteristics of the fiber according to Example 7 of the present invention with the fibers of Comparative Examples 1–4. The statistical data of Table 4 is based on a population of 30 fibers for each Example and Comparative Example.

The cohesion of the resulting fibers was measured to be 6.5. The fibers had a melt flow rate of 21 dg/min, as measured in accordance with ASTM D-1238, 230° C. and 2.16 kg load. The resulting fibers had a melt gradient index of 50 suggesting formation of a skin which was confirmed by examination by hot stage microscopy.

Referring to Tables 4 and 5, EXC is an exclusion factor or threshold for measuring crimps. If the amplitude of the crimp does not exceed the exclusion factor, it is not counted as a crimp. CPI is crimps per inch. STD is the standard deviation of the CPI. STD/CPI is STD divided by CPI. LEG/LTH is the average length of the crimps in inch. LEG/AMP is the average amplitude of the crimps of the fibers in inch. NO/CPI is the percentage of the total length which has no crimps. OP/ANG is the open angle which is the angle formed by two consecutive peaks enclosing a valley wherein 180° corresponds to horizontal. REL/STR is the ratio of the length of the fiber when the fiber is relaxed compared to when the fiber is stretched.

It is recommended to use the exclusion factor (EXC in Table 4) of 0.005 which avoids measuring insignificantly small amplitude crimps. The fiber of the present invention (Example 7) has crimps per inch (CPI) of 19.75 at this exclusion factor and a crimp leg length (LEG/LTH) of 0.02275, which is the highest among all the data shown in Tables 4 and 5. Longer crimp leg length is usually preferred for better performance in carding machines. The resulting fiber of the present invention was very soft due to its fineness.

TABLE 4

| Example | EXC | CPI | STD | STD/CPI | LEG/LTH | LEG/AMP |
|---|---|---|---|---|---|---|
| Comparative 1 | 0 | 24.47 | 5.97 | 0.243 | 0.02043 | 0.00417 |
| Comparative 1 | 0.005 | 20.55 | 5.61 | 0.271 | 0.02013 | 0.00364 |
| Comparative 1 | 0.02 | 5.14 | 3.35 | 0.670 | 0.02040 | 0.00146 |
| Comparative 2 | 0 | 28.68 | 6.58 | 0.233 | 0.01571 | 0.00277 |
| Comparative 2 | 0.005 | 22.70 | 4.89 | 0.216 | 0.01553 | 0.00248 |
| Comparative 2 | 0.02 | 2.34 | 2.46 | 1.112 | 0.01551 | 0.00241 |
| Comparative 3 | 0 | 30.15 | 8.21 | 0.275 | 0.01675 | 0.00294 |
| Comparative 3 | 0.005 | 22.50 | 6.14 | 0.276 | 0.01597 | 0.00255 |
| Comparative 3 | 0.02 | 2.59 | 2.73 | 1.189 | 0.01578 | 0.00062 |
| Comparative 4 | 0 | 31.78 | 8.66 | 0.275 | 0.01562 | 0.00262 |
| Comparative 4 | 0.005 | 21.08 | 5.48 | 0.260 | 0.01543 | 0.00217 |
| Comparative 4 | 0.02 | 2.07 | 2.54 | 1.237 | 0.01538 | 0.00046 |

TABLE 4-continued

| Example | EXC | CPI | STD | STD/CPI | LEG/LTH | LEG/AMP |
|---|---|---|---|---|---|---|
| Example 7 | 0 | 23.90 | 9.37 | 0.392 | 0.02452 | 0.00672 |
| Example 7 | 0.005 | 19.75 | 8.71 | 0.441 | 0.02275 | 0.00607 |
| Example 7 | 0.02 | 6.02 | 5.24 | 0.870 | 0.02138 | 0.00290 |

TABLE 5

| Example | EXC | NO/CPI | OP/ANG | REL/STR |
|---|---|---|---|---|
| Comparative 1 | 0 | 5.84 | 155.67 | 0.965 |
| Comparative 1 | 0.005 | 14.75 | 154.88 | 0.966 |
| Comparative 1 | 0.02 | 68.53 | 133.80 | 0.968 |
| Comparative 2 | 0 | 11.07 | 156.35 | 0.969 |
| Comparative 2 | 0.005 | 22.32 | 153.87 | 0.970 |
| Comparative 2 | 0.02 | 84.73 | 89.70 | 0.969 |
| Comparative 3 | 0 | 6.49 | 159.20 | 0.974 |
| Comparative 3 | 0.005 | 23.06 | 156.22 | 0.972 |
| Comparative 3 | 0.02 | 84.27 | 82.04 | 0.972 |
| Comparative 4 | 0 | 6.67 | 159.87 | 0.975 |
| Comparative 4 | 0.005 | 25.74 | 158.03 | 0.975 |
| Comparative 4 | 0.02 | 86.23 | 80.94 | 0.974 |
| Example 7 | 0 | 10.68 | 144.54 | 0.936 |
| Example 7 | 0.005 | 20.22 | 144.46 | 0.941 |
| Example 7 | 0.02 | 65.71 | 97.19 | 0.935 |

With the above examples in mind, short spin technology with the use of a heated plate facilitated the processing of a wide molecular weight distribution polymer. At higher spinnerette temperatures, however, the split did not occur because of inadequate quench.

Examples 8–29

The following Examples 8–29 involve a long spin setup with a relatively small, 2-way split spinnerette (the same as in Examples 1–6), with an unheated plate. These experiments were conducted on a single spinning position.

These Examples involve a polypropylene having a broad MWD and a nominal MFR of 9 as described in Examples 1–6 (P165 including 0.05% Irgafos 168). Further, the line speed (as measured at the take-up roll) for these Examples was varied between 550 m/min and 2200 m/min, as listed in Table 6 below.

In the extruder (same as in Examples 1–6) the temperature set points were 215° C. for zone 1, 215° C. for zone 2, and 284° C. for the elbow.

The throughput of polymer was varied, with the throughputs being listed in g/min/capillary in Table 6. Examples 8–29 differ from Examples 1–6 also in the quench mode. The average quench air velocity in the former experiments was 100–300 ft/min. while for Examples 1–6 the quench air velocity was of the order of 1000 ft/min.

The spinnerette was mounted on a long spin setup.

In Table 6, Minimum DPF was measured by following the guidelines set forth in ASTM D-1577. In Examples 10 and 13 the dpf could not be measured because of winder speed limitations. Melt flow rate (MFR) was measured by following the guidelines set forth in ASTM D-1238. Hot stage microscopy involves inspection of fibers under a hot stage microscope as the temperature is increased at 3° C./min, with the amount of skin being categorized as G=good, F=fair, P=poor, and N=none.

In the examples listed in Table 6, three target deniers were examined. In Examples 8, 10, 12, 14, 16, 18, 20, 22, 26, 27, and 29, the target denier was 4.0 denier split into 2.0 denier. In Examples 9, 11, 13, 15, 17, 19, 21, and 23, the target denier was 2.0 denier split into 1.0 denier. In Examples 24, 25, and 28, the target denier was 8.0 denier split into 4.0 denier.

It is noted that in some examples, as indicated in Table 6, a shroud of 20 mm was placed immediately below the spinnerette to obtain a quench delay.

TABLE 6

| Ex. | Take-up (m/min) | Through-put (g/min/capillary) | Cal-cu-lated DPF | Mini-mum DPF | Spinnerette Surface Temperature (° C.) | Shroud Length (mm) |
|---|---|---|---|---|---|---|
| 8 | 1100 | 0.181 | 2 | 0.74 | 260 | 20 |
| 9 | 2200 | 0.181 | 1 | — | 260 | 20 |
| 10 | 1100 | 0.181 | 2 | 1 to 2 | 260 | 0 |
| 11 | 2200 | 0.181 | 1 | — | 260 | 0 |
| 12 | 1100 | 0.181 | 2 | 1 to 2 | 240 | 20 |
| 13 | 2200 | 0.181 | 1 | — | 240 | 20 |
| 14 | 1100 | 0.181 | 2 | 1 to 2 | 240 | 0 |
| 15 | 2200 | 0.181 | 1 | — | 240 | 0 |
| 16 | 700 | 0.123 | 2 | 0.513 | 280 | 20 |
| 19 | 1400 | 0.123 | 1 | — | 280 | 20 |
| 18 | 700 | 0.092 | 2 | 0.403 | 280 | 0 |
| 19 | 1400 | 0.092 | 1 | — | 280 | 0 |
| 20 | 1100 | 0.181 | 2 | — | 300 | 20 |
| 21 | 2200 | 0.181 | 1 | | 300 | 20 |
| 22 | 1100 | 0.181 | 2 | | 300 | 0 |
| 23 | 2200 | 0.181 | 1 | | 300 | 0 |
| 24 | 550 | 0.181 | 4 | | 280 | 0 |
| 25 | 550 | 0.181 | 4 | | 280 | 20 |
| 26 | 550 | 0.090 | 2 | | 280 | 20 |
| 27 | 550 | 0.090 | 2 | | 280 | 0 |
| 28 | 550 | 0.181 | 4 | | 260 | 20 |
| 29 | 550 | 0.090 | 2 | | 260 | 20 |

TABLE 7

| Ex. | MFR | Hot Stage Test | Comments |
|---|---|---|---|
| 8 | 16.7 | P to N | |
| 9 | 15.3 | P to N | |
| 10 | 12.5 | P to N | |
| 11 | — | | No run |
| 12 | 11.3 | P to N | |
| 13 | — | | No run |
| 14 | 10.9 | P to N | |
| 15 | — | | No run |
| 16 | 39.3 | P | |
| 17 | 40.6 | P to F | Minimum DPF not possible due to limit on take-up speed |
| 18 | 26.3 | P to N | |
| 19 | 24.3 | P to N | |
| 20 | — | | Minimum DPF not possible due to limit on take-up speed |
| 21 | * | | |
| 22 | * | | |
| 23 | * | | |
| 24 | * | P | |
| 25 | * | P to F | |
| 26 | * | P | |
| 27 | * | P to N | |
| 28 | * | P to N | |
| 29 | * | P to N | |

* = not measured

From Examples 8–29, it was evident that combinations of polymer temperature and shroud lengths that result in colder environments had difficulty running. Further, the spinning performance was more sensitive to the fiber dpf than that in the short spin setup. Overall, the spinning behavior is noticeably poorer for the long spin configuration.

Examination by microscope of the cross-section of fibers from the 1.0 dpf long spin set up of Example 9 and the 2.0 dpf long spin setup of Example 12, showed that these fibers did not split. The fiber cross-sections, however, had an interesting shape resembling a distorted I-beam. Based on the I-beam theory, these fibers may have a higher modulus than simple cylindrical fibers.

One reason that the long spin configuration failed to give a successful fiber split is that the spun fiber needs a considerably longer vertical distance from the spinnerette to reach a solid state compared to the short spin. Thus, the filament, even after the split, tends to re-merge together.

A comparison of the cross-sections of Examples 6, 9, and 12 showed a difference in the shapes of merged fibers. The fibers of Examples 9 and 12 may have been split once and merged together later, while those of Example 6 may not have split at all (as judged from the appearance of the cross-section).

Examples 30–31

The following Examples 30–31 involve a short spin setup with use of a relatively large, 2-way split spinnerette with a heated plate (the same as used in Example 7). The materials and conditions used were the same as in Example 7, except as stated below.

A spinnerette having capillary dimensions equal to those used in Example 7 was used. In particular, the spinnerette was similar to the one shown in FIGS. 2A–2C, except that only one half the number of capillaries were used, with the capillaries being arranged in a square pattern in the middle of the spinnerette. Thus, the spinnerette had 12,700 capillaries rather than 25,400 capillaries. Accordingly, for successful fiber splits, this spinnerette would yield 25,400 filaments, as opposed to 50,800 filaments for the spinnerette having 25,400 capillaries.

The spinnerette was heated by electrical resistance heating and the temperature of the spinnerette was varied. The temperature of the spin head was set at 245° C.

The throughput of polymer was set at 200 lb/hr which converts to 0.060 g/min/capillary.

The spinnerette was mounted on a short spin setup. In particular, the quench was set at 4.5 psi of air at a set point of 67° C. Quench nozzles were located 2 inches from the spinnerette, angles about 30°, air speed about 80 ft/min exhausted from the gap of 15 mm.

After the fibers were quenched, the speed of the tow of filaments from the spinnerette was set at 64 m/min. A first septet of rolls was set at 37° C. and at a speed of 64 m/min. A second septet of rolls was set at 36° C. and at a speed of 65 m/min. Thus, the draw ratio was set at 1.01.

After passing through the first and second septets, the tow was passed through a steam chest to a crimper.

In Example 30, in order to assure good openability in the card machine (Hollingsworth on Wheels, Greenville, S.C.), the spun filaments were fed through a standard blooming jet just before the cutter. The fiber tow bypassed all of the drawing rolls and the crimper to feed into the blooming jet which is an air aspirator to open fibers so that it will give desired cohesiveness of the tow.

In Example 31, the staple fiber obtained from the jet bloomed, and cut fiber resulted in a very soft, but rather low, cohesion sample. To ensure carding despite the low cohesion, the self-crimping fiber was fed to a standard crimper. The flapper pressure of the crimper was set at 1.8 psi. The fiber was fed to the crimper bypassing all draw rolls. Although it is usually very difficult to mechanically crimp fiber without having any draw on the fiber, the self-crimping made it possible to mechanically crimp without any draw. This additional crimping resulted in a higher CPI as shown in Table 8 below. The characteristics of the mechanically crimped fiber of Example 31 were much different from the unmechanically crimped self-crimping fiber of Example 30. The crimping of the self-crimped fiber of Example 30 was very uniform and sinusoidal, while the crimping of the mechanically crimped fiber of Example 31 was irregular and included crimps which were relatively jagged.

After passing through the inactive crimper for Example 30 or the active crimper for Example 31, 7.5 wt % of "PP912" finish (available from Ghoulston Technology, Charlotte, N.C.) was applied to the tow. The tow was then sent to a cutter and then to a baler.

The resulting fibers had a cohesion of 7.85. The fibers had a melt flow rate of 21.5 (Ex. 30) and 19.6 (Ex. 31) dg/min, respectively, as measured in accordance with ASTM D-1238, 230° C. and 2.16 kg load. The resulting fibers had a melt gradient index of 50 suggesting formation of a skin which was confirmed by examination by hot stage microscopy.

TABLE 8

| Ex. | Crimping | CPI | STD | Denier | Tenacity g/denier | Elongation |
|---|---|---|---|---|---|---|
| 30 | No | 20.8 | 7.6 | 1.23 | 1.46 | 265% |
| 31 | Yes | 35.5 | 9.6 | 1.26 | 1.56 | 286% |

Examination by microscope of the cross-section of fibers of Example 30 showed that most of these fibers were split and had a half-circular cross-section.

The unmechanically crimped fiber of Example 30 was unable to be run on a bonding line due to low fiber cohesion. The carded web emerging from the doffer, partially wrapped back onto the doffer cylinder, resulted in a distorted carded web.

Fabric samples obtained from Example 30 at very low bonding speed (40 ft/min.) showed a higher cross directional strength (CD) at lower than usual temperature. The fabric bonded at 130° C. had a CD of 677 g/in at 20 gsy.

The mechanically crimped fiber of Example 31 had no problem running on the bonding line. As shown in Table 9 below, the resulting fabric was much softer when compared with a commercially available control fabric (obtained from Procter & Gamble). In Table 9, the fabrics based on the fibers of Example 31 of the present invention are denoted as R (bonding temperature 154° C.), S (bonding temperature 157° C.), and T (bonding temperature 160° C.). The control sample is denoted as N.

At the top of Table 9, the capitalized letters indicate a comparison of the fabrics. For example, NR is a comparison of N and R. If a panelist believes that the first fabric (N in the case of NR) is softer than the second value (R in the case of NR), a positive value is given. If a panelist believes that the second fabric is softer than the first fabric, a negative value is given. For instance, if the first fabric is slightly softer than the second fabric, a value of 1 is given. If the panelist "knows" that the first fabric is softer than the second fabric, a value of 2 is given

TABLE 9

| Panelist | NR | NS | NT | RS | RT | ST |
|---|---|---|---|---|---|---|
| 1 | −2 | −1 | −1 | 0 | 1 | 1 |
| 2 | −2 | −2 | −2 | 1 | 1 | 1 |
| 3 | −3 | −3 | −3 | 2 | 1 | −1 |
| 4 | −2 | −1 | −1 | 0 | 1 | 1 |
| 5 | −1 | −1 | −1 | 1 | 1 | −1 |
| 6 | −1 | −1 | −1 | 0 | −1 | 1 |
| 7 | −2 | −2 | −2 | 2 | 1 | 0 |
| 8 | −1 | −2 | −1 | −2 | −2 | 0 |
| 9 | −2 | 2 | −2 | −3 | 0 | −3 |
| 10 | −2 | −1 | −2 | −1 | −1 | −1 |

Table 9 shows that fabrics made from the fibers of Example 31 of the present invention are softer than the fabrics made from the control fibers because of the presence of negative numbers when the control fabric is listed first. Table 10 below is based on the data of Table 9. Table 10 is a summary of the softness for each sample. For each sample, each value was obtained by summing all the data for the given sample for each panelist. If the sample is the first fabric listed in the comparisons of Table 9 (e.g., N in the case of NR), the value is used directly in the summing. If the sample is the second fabric listed in the comparisons of Table 9 (e.g., R in the case of NR), the sign is changed before the summing. For example, for panelist 1 for N: (−2)+(−1)+(−1)=(−4). Also, for panelist 1 for R: 2+0+1=3. Thus, a positive number represents a softer fabric.

TABLE 10

| Panelist | N | R | S | T | $N^2 + R^2 + S^2 + T^2$ |
|---|---|---|---|---|---|
| 1 | −4 | 3 | 2 | −1 | 30 |
| 2 | −6 | 4 | 2 | 0 | 56 |
| 3 | −9 | 6 | 0 | 3 | 126 |
| 4 | −4 | 3 | 2 | −1 | 30 |
| 5 | −3 | 3 | −1 | 1 | 20 |
| 6 | −3 | 0 | 2 | 1 | 14 |
| 7 | −6 | 5 | 0 | 1 | 62 |
| 8 | −4 | −3 | 4 | 3 | 50 |
| 9 | −2 | −1 | −2 | 5 | 34 |
| 10 | −5 | 2 | −1 | 4 | 46 |
| SUM | −46 | 22 | 8 | 16 | |
| SQ SUM | 2116 | 484 | 64 | 256 | |
| PSU | 0 | 1.7 | 1.35 | 1.55 | |
| YARD-STICK | 0 | 3.259725 | 2.588605 | 2.972102 | |

In the above table the values of PSU(=Panel Softness Unit) were calculated as follows:

$$PSU(N)=(1-N)/X\cdot Y$$

$$PSU(R)=(R-N)/X\cdot Y$$

$$PSU(S)=(S-N)/X\cdot Y$$

$$PSU(T)=(T-N)/X\cdot Y$$

With

X=number of samples per panel; and

Y=number of judges per panel

The higher the value of PSU in comparison to the standard (PSU=0), the softer the fabric. The value of YARDSTICK was calculated by dividing PSU for a sample by the least square difference at 95%. It is a measure of comparative difference at a 95% confidence level.

From Table 10, sample R is rated to be the softest according to these panelists. It should be noted that a difference of at least 1 PSU is considered to be significant.

Tables 11 and 12 include data concerning the cross and machine direction bonding curves, respectively, for fabrics made from the fibers of Example 31. In Tables 11 and 12, the line speed was 250 ft/min and the fibers had a cohesion of 7.85. The fibers had a melt flow rate of 19.6 dg/min, as measured in accordance with ASTM D-1238, 230° C. and 2.16 kg load. The resulting fibers had a melt gradient index of 48 suggesting formation of a skin which was confirmed by examination by hot stage microscopy. CD is cross direction and MD is machine direction. For each bonding temperature, the fabric population for tensile measurements consisted of 6 samples. The data was normalized to a standard weight of 20 g/yd$^2$. "Percent elong," is the percent elongation before breakage of the fibers, as measured by an Instron tensile machine. "TEA" is the total energy absorbed, as measured by the area under the stress-strain curve.

TABLE 11

| | Raw Weight Six Strips | | Normalized Weight | | Non-Normalized Data | | Normalized Data | |
|---|---|---|---|---|---|---|---|---|
| Bonding Temp. (° C.) | for CD (g) | for MD (g) | for CD (g/yd$^2$) | MD (g/yd$^2$) | CD (g/in) | MD (g/in) | CD (g/in) | MD (g/in) |
| 142 | 0.61 | 0.57 | 18.8 | 17.6 | 139 | 2085 | 148 | 2369 |
| 145 | 0.54 | 0.51 | 16.7 | 15.7 | 174 | 1714 | 208 | 2183 |
| 148 | 0.55 | 0.53 | 17 | 16.4 | 214 | 1928 | 252 | 2351 |
| 151 | 0.53 | 0.52 | 16.4 | 16 | 240 | 2062 | 293 | 2578 |
| 154 | 0.52 | 0.48 | 16 | 14.8 | 277 | 1967 | 346 | 2658 |
| 157 | 0.55 | 0.55 | 17 | 17 | 291 | 2227 | 342 | 2620 |
| 160 | 0.58 | 0.55 | 17.9 | 17 | 367 | 2302 | 410 | 2708 |
| 163 | 0.54 | 0.56 | 16.7 | 17.3 | 280 | 2054 | 335 | 2375 |
| 166 | 0.56 | 0.57 | 17.3 | 17.6 | 286 | 1390 | 331 | 1580 |

TABLE 12

| Bonding Temp. (° C.) | CD-STD | MD-STD | Percent Elong. CD | Percent Elong. MD | Non-normalized Data TEA CD (g-cm/in) | Non-normalized Data TEA MD (g-cm/in) | Normalized Data TEA CD (g-cm/in) | Normalized Data TEA MD (g-cm/in) |
|---|---|---|---|---|---|---|---|---|
| 142 | 30 | 214 | 79 | 52 | 739 | 7088 | 786 | 8055 |
| 145 | 9 | 174 | 91 | 92 | 1023 | 10210 | 1225 | 13006 |
| 148 | 51 | 138 | 95 | 90 | 1353 | 11101 | 1592 | 13538 |
| 151 | 46 | 370 | 103 | 95 | 1599 | 12618 | 1950 | 15773 |
| 154 | 62 | 227 | 100 | 99 | 1790 | 12546 | 2238 | 16954 |
| 157 | 92 | 163 | 92 | 86 | 1801 | 12272 | 2119 | 14438 |
| 160 | 68 | 308 | 102 | 80 | 2433 | 11948 | 2718 | 14057 |
| 163 | 78 | 592 | 88 | 57 | 1645 | 8052 | 1970 | 9309 |
| 166 | 65 | 178 | 79 | 76 | 1497 | 6846 | 1731 | 7780 |

Figure 6:
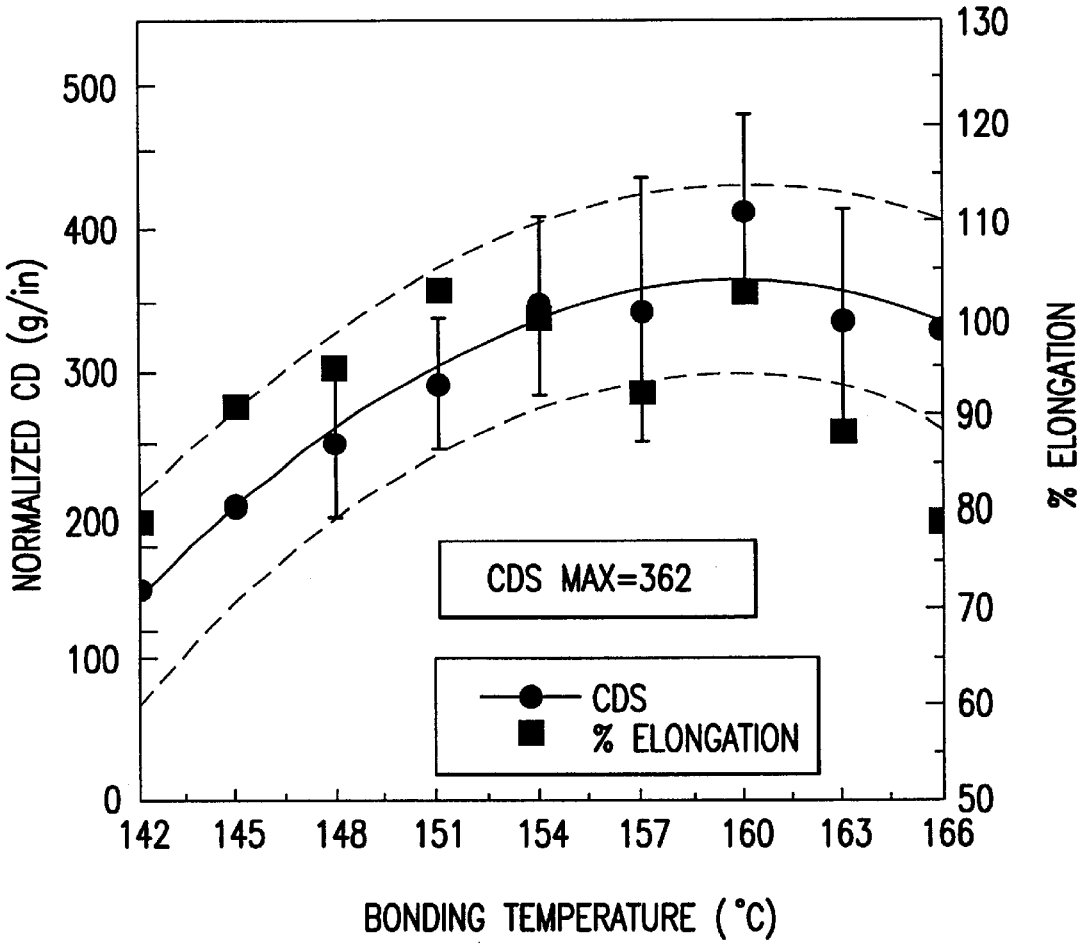
FIG. 6 is a graph showing a cross direction bonding curve of a nonwoven fabric made from short spin 2-way split fibers of the present invention which have been mechanically crimped.
Figure 7:
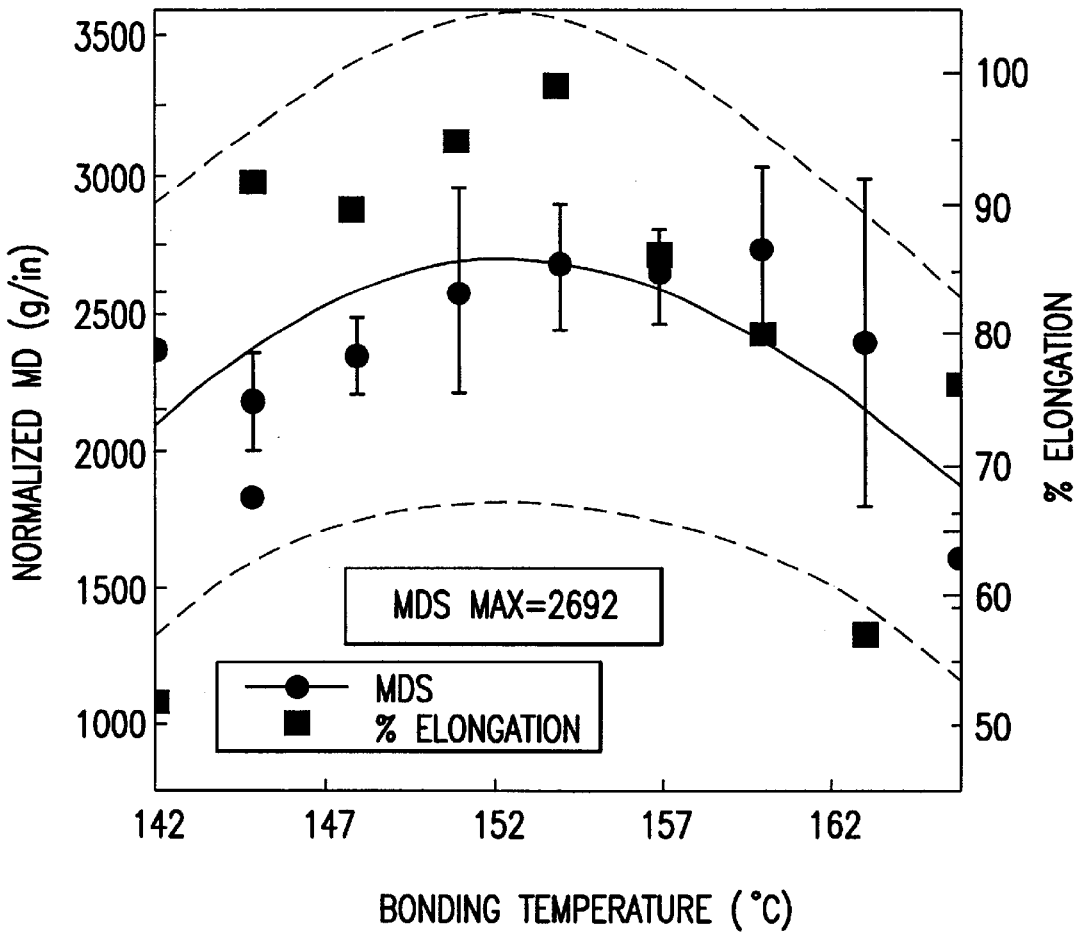
FIG. 7 is a graph showing a machine direction bonding curve for the nonwoven fabric of FIG. 6.

FIGS. 6 and 7 are based on data found in Tables 11 and 12, respectively, and show cross and machine direction bonding curves, respectively, for the fibers of Example 31. The maximum CD and MD values are within the range of values found for fabric made from high cohesion fiber (cohesion 7.8). The shapes of the bonding curves are fairly flat which is a preferred shape, and the peak strengths are observed at relatively low temperatures.

Table 13 presents the results of fabric uniformity tests performed on fabrics of Example 31. The data of Table 13 is based on a population of 5 samples. The basis weight was 17.20 g/yd$^2$. The denier of the fibers was 1.0 and the cut length was 1.5". Regarding the coverage data, the total area per sample was 14,193 mm$^2$ (5.5 in×4.0 in). This total area was divided into 60452 smaller areas of 0.23 mm$^2$ for measurement.

TABLE 13

| Uniformity % Black Areas > 2.2 mm$^2$ | Uniformity % Black Areas > 27 mm$^2$ | Uniformity % Thin Area | Normalized to 20 g/yd$^2$ Std. Dev. (% white) | Coverage Normalized to 20 g/yd$^2$ Average (% white) | Coverage As received Average (% white) |
|---|---|---|---|---|---|
| 5.05 | 2.76 | 11.17 | 11.3 | 70 | 61 |

The data of Table 13 shows that the fabric is very uniform in terms of percent whiteness (70, normally about 50%), percent white standard deviation (11.3, normally 12–14), percent thin area (11.17%, normally 13–14%).

Examples 33–42

Examples 33–42 involve a long spin setup with use of a relatively small, electrically heated, 3-way split spinnerette having 9 capillaries in the spinnerette. The experiments were conducted on a single position experimental station.

The polymer for these examples was polypropylene having a broad MWD and a nominal MFR of 10 comprising 0.06 wt % of "Irgafos 168". Further, the spinning speed (measured at the take-up Godet roll) was varied as shown in Table 14 below.

In the extruder (the same as used in Examples 1–6) the temperature set points were 250, 260, 270 and 280° C. for zones 1, 2, 3, and 4, respectively.

The capillaries were similar to the capillary shown in FIGS. 3A–3C, with (DW3)=0.30 mm, (UD3)=1.50 mm, (LD3)=1.20 mm, (RW3)=0.15 mm, (DH3)=1.20 mm, (LDH3)=1.20 mm, and (CL3)=25 mm.

The spin head temperature set point was varied as shown in Table 14 below.

The throughput ranged from 1.5 gm/min to 2.5 gm/min depending on the target dpf as shown in Table 14.

The spinnerette was mounted on a long spin setup.

The quench level was controlled by setting the percentage of maximum available fan speed. For example, 5% cross air fan rating produced about 73 ft/min. quench air speed.

In Table 14 below, the quench is based on the percentage of maximum fan rpm available. The fiber split quality index is a subjective measure of the fiber split quality utilizing a scale of 0 to 10, with 0 being not split and 10 being split 95–100%.

TABLE 14

| Example | Target DPF | Actual DPF | Spinning Speed (m/min) | Spinnerette Head Temp. (° C.) | Quench (% of max fan rpm) | Fiber Split Quality Index |
|---|---|---|---|---|---|---|
| 33 | 1.5 | N/A | 1000 | 282 | 5 | 10 |
| 34 | 2.5 | N/A | 1000 | 283 | 5 | 5 |
| 35 | 1.5 | N/A | 1200 | 283 | 5 | 6 |
| 36 | 2.5 | N/A | 1200 | 283 | 5 | 7 |
| 37 | 1.5 | N/A | 1000 | 283 | 5 | 7 |
| 38 | 1.5 | 0.64 | 1000 | 283 | 10 | 10 |
| 39 | 2.5 | N/A | 1000 | 283 | 10 | 9 |
| 40 | 1.5 | 0.63 | 1200 | 283 | 10 | 10 |
| 41 | 2.5 | N/A | 1200 | 283 | 10 | 2 |
| 42 | 1.5 | 1.44 | 1000 | 283 | 5 | 9 |

Table 14 generally shows that slower spinning speeds and smaller fiber sizes facilitated production of the split fibers.

Examples 43–63

Examples 43–63 involve a long spin setup with use of a relatively small, electrically heated, 4-way split spinnerette. Again this experiment was conducted on a single position experimental station.

The polymer for these examples was polypropylene (P165 including 0.05% Irgafos 168) having a broad MWD and a nominal MFR of 10 comprising 0.06 wt % of "Irgafos 168". Further, the spinning speed was varied as listed in Tables 15 and 16 below.

In the extruder (the same as that used in Examples 1–6) the temperature set points were 240, 250, 260 and 270° C. for zones 1, 2, 3, and 4, respectively. The spinnerette capillaries (9 holes) were similar to the capillary shown in FIGS. 4A–4C, with (DW4)=0.30 mm, (UD4)=1.50 mm, (LD4)=1.20 mm, (RW4)=0.15 mm, (DH4)=1.20 mm, (LDH4)=1.20 mm, and (CL4)=25 mm.

The throughput was varied depending on the target dpf as shown in Table 15, ranging from 2.0 gm/min to 4.2 gm/min.

The spinnerette was mounted on a long spin setup.

In Table 15 below, the quench is based on the percentage of the maximum fan rpm available. The fiber split quality index is a subjective measure of the fiber split quality utilizing a scale of 0 to 10, with 0 being no split and 10 being 95–100% split. In Table 15, the size of the fiber, the spinnerette head temperature, and the spinning speed are varied to observe the effect of these variables on the quality of the fiber. The number of breaks was determined for a time period of approximately 9 minutes. Q in Table 15 below means throughput.

TABLE 15

| Ex. | Target DPF | Actual DPF | Spinning Speed (m/min) | Spinnerette Head Temp. (° C.) | Quench (% of max. fan rpm) | Number of Breaks* | Q (g/min) | Fiber Split Quality Index |
|---|---|---|---|---|---|---|---|---|
| 43 | 2.00 | 0.63 | 1000 | 268 | 15 | 2 | 2.00 | 10 |
| 44 | 3.50 | 3.47 | 1000 | 268 | 15 | — | 3.50 | 4 |
| 45 | 2.00 | 1.01 | 1200 | 268 | 15 | 4 | 2.40 | 8 |
| 46 | 3.50 | 3.66 | 1200 | 268 | 15 | — | 4.20 | 4 |
| 47 | 2.00 | 0.42 | 1000 | 268 | 15 | 6 | 2.00 | 10 |
| 48 | 2.00 | 0.62 | 1000 | 282 | 15 | 1 | 2.00 | 9 |
| 49 | 3.50 | 3.30 | 1000 | 283 | 15 | 1 | 3.50 | 4 |
| 50 | 2.00 | 1.92 | 1200 | 283 | 15 | — | 2.40 | 7 |
| 51 | 3.50 | 3.35 | 1200 | 283 | 15 | — | 4.20 | 6 |
| 52 | 2.00 | 1.81 | 1000 | 283 | off | — | 2.00 | 8 |
| 53 | 2.00 | 2.56 | 1000 | 269 | 15 | — | 2.00 | 8 |

*"—" means no breaks

By comparing the Fiber Split Quality Index of the different examples of Table 15, it is apparent that with a lower dpf there is a better chance of obtaining a split into four fibers. It is also clear that lower spinning speed and lower temperature yield better splits.

In Table 16 below, the temperature of the spin head was held constant while the size of the fibers, the spinning speed, and the quench were varied. This experiment targeted lower denier as compared to the experiments depicted in Table 15.

TABLE 16

| Example | Target DPF | Spinning Speed (m/min) | Spinnerette Head Temp. (° C.) | Quench (% max. fan rpm) | Fiber Split Quality Index |
|---|---|---|---|---|---|
| 54 | 1.5 | 1000 | 291 | 5 | 5 |
| 55 | 2.5 | 1000 | 291 | 5 | 0 |
| 56 | 1.5 | 1200 | 292 | 5 | 6 |
| 57 | 2.5 | 1200 | 292 | 5 | 0 |
| 58 | 1.5 | 1000 | 292 | 5 | 10 |
| 59 | 2.5 | 1000 | 292 | 10 | 10 |
| 60 | 1.5 | 1000 | 292 | 10 | 9 |
| 61 | 2.5 | 1200 | 292 | 10 | 10 |
| 62 | 1.5 | 1200 | 291 | 10 | 9 |
| 63 | 2.5 | 1000 | 292 | 5 | 9 |

Table 16 shows that smaller fibers require slower spinning speeds, and that faster fan s generally resulted in better splits.

Examples 64–92

Examples 64–92 relate to the formation of a fat C-shaped fiber utilizing two versions of a spinnerette. In one version, a 9 hole experimental spinnerette having a round cross-section with a diameter of 20 mm and capillaries positioned 4 mm apart vertically and horizontally was used, and in the other version a 636 hole full scale spinnerette having a substantially rectangular shape of 200 mm×75 mm and capillaries positioned 5 mm apart vertically and horizontally was used.

Fibers were spun using P-165 including 0.05% Irgafos 168 in the 9 hole spinnerette utilizing the conditions illustrated in Table 17 for Examples 64–76.

TABLE 17

| Ex. | Take Up Speed (m/min) | Total Throughput g/min | Quench Air Flow Rate | Extruder Temperature (° C.) | Target dpf | Continuity |
|---|---|---|---|---|---|---|
| 64 | 1000 | 3.18 | 0 | 260 | 2.20 | GOOD |
| 65 | 1200 | 3.81 | 0 | 260 | 2.20 | GOOD |
| 66 | 1200 | 3.12 | 0 | 260 | 1.80 | GOOD |
| 67 | 1200 | 2.60 | 0 | 260 | 1.50 | NO SPIN |
| 68 | 1200 | 2.60 | 0 | 270 | 1.50 | FAIR |
| 69 | 1400 | 3.64 | 0 | 270 | 1.80 | GOOD |
| 70 | 1400 | 3.64 | 10 | 280 | 1.80 | GOOD |
| 71 | 1400 | 3.64 | 15 | 285 | 1.80 | FAIR |
| 72 | 1250 | 3.61 | 15 | 285 | 2.00 | FAIR |
| 73 | 1500 | 3.47 | 15 | 285 | 1.60 | POOR |
| 74 | 1500 | 3.47 | 5 | 285 | 1.60 | GOOD |
| 75 | 500 | 4.33 | 15 | 285 | 6.00 | FAIR |
| 76 | 250 | 3.61 | 20 | 250 | 10.00 | GOOD |

The full scale spinnerette was used to make of 1.5×draw 3.0 denier fiber. The take-up speed was 600 m/min and fiber was processed at 150 m/min. Subsequently, the fiber was bond for 20 and 30 gm per square meter (gsm) fabric weight. Two different bond rolls were used to make the fabric. The first roll has a diamond-shape bond spot with a bond area of approximately 15%, while the second roll had a waffle-shape bond pattern with a bond area of approximately 11%. The resulting fabric was test for strength and resilicency as shown in Tables 18 and 19, respectively.

In the resilicency tests shown in Table 19, "Percent Compression" is defined by $[(T_1-T_2)/T_1]*100$ and "Percent Recovery" is defined by $(T_3/T_1)*100$, where $T_1$ is initial thickness, $T_2$ is compressed thickness after 30 minutes of compression with a weight, and $T_3$ is the recovered thickness after five minutes of releasing the load. Table 19 illustrates that the resiliency of the notched fiber according to the present invention is excellent compared to standard polypropylene fiber having a circular cross-section which has an average recovery number of about 75–78%.

TABLE 18

| Ex. | Roll | Fabric Wt. (gsm) | Bond Temp. (° C.) | CD (g/in) | CD % Elongation | CD TEA (g-cm/in) | MD (g/in) | MD % Elongation | MD TEA (g-cm/in) |
|---|---|---|---|---|---|---|---|---|---|
| 77 | 1 | 20 | 157 | 211 | 100 | 1434 | 1714 | 59 | 8431 |
| 78 | 1 | 30 | 157 | 313 | 106 | 2138 | 2986 | 88 | 24199 |
| 79 | 1 | 20 | 162 | 214 | 79 | 1095 | 1622 | 45 | 5867 |
| 80 | 1 | 30 | 162 | 361 | 104 | 2412 | 3030 | 81 | 21871 |
| 81 | 2 | 20 | 157 | 92 | 85 | 569 | 1339 | 44 | 3331 |
| 82 | 2 | 30 | 157 | 174 | 96 | 1082 | 2524 | 82 | 19988 |
| 83 | 2 | 20 | 162 | 112 | 90 | 662 | 1321 | 40 | 4485 |
| 84 | 2 | 30 | 162 | 188 | 103 | 1272 | 2103 | 55 | 10543 |

TABLE 19

| Ex. | Roll | Bond Temp. (° C.) | Fabric Wt. (gsm) | % Compression | % Recovery |
|---|---|---|---|---|---|
| 85 | 1 | 157 | 20 | 48 | 79 |
| 86 | 1 | 162 | 20 | 45 | 90 |
| 87 | 1 | 157 | 30 | 42 | 82 |
| 88 | 1 | 162 | 30 | 42 | 81 |
| 89 | 2 | 157 | 20 | 56 | 84 |
| 90 | 2 | 262 | 20 | 57 | 73 |
| 91 | 2 | 157 | 30 | 56 | 71 |
| 92 | 2 | 162 | 30 | 56 | 69 |

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A process of making polymeric fiber, comprising:

passing a molten polymer through a spinnerette comprising a plurality of capillaries which have capillary ends with dividers which divide each capillary end into a plurality of openings so that the molten polymer is formed into separate polymeric fibers for each opening or the molten polymer is formed into partially split fiber for each capillary; and quenching the molten polymer to form polymeric fiber.

2. The process of claim 1, wherein the polymer comprises polypropylene.

3. The process of claim 1, wherein a polymer flow rate per capillary is about 0.02 to about 0.9 g/min/capillary.

4. The process of claim 1, wherein the polymeric fiber has a spun denier of about 0.5 to about 1.5.

5. The process of claim 1, wherein the plurality of capillaries have a diameter of about 0.2 to about 1.3 mm.

6. The process of claim 1, wherein the plurality of capillaries comprise a capillary upper diameter which is less than a capillary lower diameter, and wherein a junction between the capillary upper diameter and the capillary lower diameter forms a ridge.

7. The process of claim 6, wherein the capillary lower diameter is about 0.2 to about 1.3 mm.

8. The process of claim 7, wherein the capillary upper diameter is about 0.6 to 3.0 mm.

9. The process of claim 8, wherein the ridge comprises a ridge width of about 0.04 to about 0.8 mm.

10. The process of claim 1, wherein the dividers comprise a divider width which is about 0.1 to about 0.4 mm.

11. The process of claim 1, wherein the dividers comprise a divider height which is about 0.2 to about 2.0 mm.

12. The process of claim 1, wherein the plurality of openings comprise two openings.

13. The process of claim 1, wherein the plurality of openings comprise three openings.

14. The process of claim 1, wherein the plurality of openings comprise four openings.

15. The process of claim 1, further comprising heating the spinnerette.

16. The process of claim 1, wherein the polymeric fiber has a substantially half-circular cross-section.

17. The process of claim 1, wherein the polymeric fiber has a fat C-shaped cross-section.

18. The process of claim 1, wherein the polymeric fiber is self-crimping.

19. The process of claim 18, further comprising mechanically crimping the polymeric fiber.

20. The process of claim 1, wherein the polymeric fiber comprises a skin-core polymeric fiber.

21. The process of claim 1, wherein the polymer is extruded in an oxidative atmosphere under conditions such that the polymeric fiber has a skin-core structure.

22. The process of claim 1, wherein the molten polymer is formed into separate polymeric fibers for each opening.

23. The process of claim 1, wherein the molten polymer is formed into partially split fiber for each capillary.

24. The process of claim 1, wherein the divider has a tapered width.

* * * * *